US009085176B2

(12) United States Patent
Piatt et al.

(10) Patent No.: US 9,085,176 B2
(45) **Date of Patent: *Jul. 21, 2015**

(54) VACUUM PULLDOWN OF PRINT MEDIUM IN PRINTING SYSTEM

(71) Applicant: Eastman Kodak Company, Rochester, NY (US)

(72) Inventors: Michael J. Piatt, Dayton, OH (US); James A. Katerberg, Kettering, OH (US); Randy D. Vandagriff, Xenia, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/040,849

(22) Filed: Sep. 30, 2013

(65) Prior Publication Data

US 2015/0091993 A1 Apr. 2, 2015

(51) Int. Cl.
*B41J 2/01* (2006.01)
*B41J 11/00* (2006.01)

(52) U.S. Cl.
CPC ..... *B41J 11/0085* (2013.01)

(58) Field of Classification Search
CPC ..... B41J 13/226; B65H 23/34
See application file for complete search history.

(56) References Cited

U.S. PATENT DOCUMENTS

| | | | | |
|---|---|---|---|---|
| 2,753,181 | A | 7/1956 | Anander | |
| 3,837,551 | A | 9/1974 | Schregenger | |
| 4,070,951 | A | 1/1978 | Bala | |
| 5,312,033 | A * | 5/1994 | Walton et al. | 226/108 |
| 6,003,988 | A * | 12/1999 | McCann et al. | 347/101 |
| 6,022,104 | A | 2/2000 | Lin et al. | |
| 6,254,090 | B1 | 7/2001 | Rhodes et al. | |
| 6,394,596 | B1 * | 5/2002 | Wotton et al. | 347/104 |
| 6,454,197 | B1 | 9/2002 | Everett | |
| 6,794,604 | B2 | 9/2004 | Herke et al. | |
| 8,052,272 | B2 * | 11/2011 | Smith et al. | 347/101 |
| 2002/0041068 | A1 | 4/2002 | Madsen et al. | |
| 2003/0218652 | A1 | 11/2003 | Nakashima | |
| 2004/0239742 | A1 | 12/2004 | Hiraki et al. | |
| 2009/0231377 | A1 * | 9/2009 | Kachi | 347/16 |
| 2011/0064506 | A1 | 3/2011 | Spence et al. | |

(Continued)

FOREIGN PATENT DOCUMENTS

| | | | |
|---|---|---|---|
| EP | 2 179 852 | | 4/2010 |
| JP | 62222952 | A * | 9/1987 |

(Continued)

*Primary Examiner* — Shelby Fidler
*Assistant Examiner* — Tracey McMillion
(74) *Attorney, Agent, or Firm* — Amit Singhal

(57) ABSTRACT

A method for printing on a moving print medium in a printing system is disclosed. The method includes providing a linehead defining one or more print zones. A plurality of transport rollers are provided, wherein at least one transport roller is disposed opposite the linehead, adjacent to the second side of the print medium, and aligned with one of the print zones. A vacuum assembly is disposed opposite the second side of the print medium and includes a vacuum manifold aligned with the aligned transport roller. The print medium is moved through the printing system and a vacuum force operates on the print medium such that at least a portion of the print medium is deflected thereby increasing a wrap angle of the moving print medium around the aligned transport roller. Liquid is jetted from the linehead onto the print medium to form a print.

17 Claims, 19 Drawing Sheets

(56) References Cited

U.S. PATENT DOCUMENTS

| | | | | |
|---|---|---|---|---|
| 2011/0205322 | A1 | 8/2011 | Maekawa | |
| 2011/0316924 | A1 | 12/2011 | Kobayashi et al. | |
| 2012/0218341 | A1* | 8/2012 | Maekawa et al. | 347/20 |
| 2013/0016165 | A1* | 1/2013 | Izawa et al. | 347/102 |

FOREIGN PATENT DOCUMENTS

| | | | |
|---|---|---|---|
| JP | 2000-086007 | | 3/2000 |
| JP | 2000086007 | A * | 3/2000 |
| JP | 2011-168020 | | 1/2011 |

* cited by examiner

VACUUM PULLDOWN OF PRINT MEDIUM IN PRINTING SYSTEM

CROSS REFERENCE TO RELATED APPLICATIONS

Reference is made to commonly-assigned, U.S. patent application Ser. No. 14/040,843, entitled "INTEGRATED VACUUM ASSIST WEB TRANSPORT SYSTEM", Ser. No. 14/040,854, entitled "VACUUM TRANSPORT ROLLER FOR WEB TRANSPORT SYSTEM", and Ser. No. 14/040,862, entitled "VACUUM PULLDOWN OF PRINT MEDIUM IN PRINTING SYSTEM", all filed concurrently herewith.

Reference is also made to commonly-assigned, U.S. patent application Ser. No. 13/483,368, entitled "VACUUM PULLDOWN OF A PRINT MEDIUM IN A PRINTING SYSTEM" filed May 30, 2012 and commonly-assigned, U.S. patent application Ser. No. 13/483,356, entitled "VACUUM PULLDOWN OF A PRINT MEDIUM IN A PRINTING SYSTEM" filed May 30, 2012.

FIELD OF THE INVENTION

The invention relates generally to the field of digitally controlled printing systems, and more particularly to transporting a print medium through a printing system. Still more particularly, the present invention relates to the use of a vacuum pulldown of the print medium as the print medium is transported through the printing system.

BACKGROUND OF THE INVENTION

In a digitally controlled printing system, such as an inkjet printing system, a print medium is directed through a series of components. The print medium can be a cut sheet or a continuous web. A web or cut sheet transport system physically moves the print medium through the printing system. As the print medium moves through the printing system, liquid, for example, ink, is applied to the print medium by one or more printheads through a process commonly referred to a jetting of the liquid. The jetting of liquid onto the print medium introduces significant moisture content to the print medium, particularly when the system is used to print multiple colors on a print medium. Due to its moisture content, the print medium expands and contracts in a non-isotropic manner often with significant hysteresis. The continual change of dimensional characteristics of the print medium often adversely affects image quality. Although drying is used to remove moisture from the print medium, drying too frequently, for example, after printing each color, also causes changes in the dimensional characteristics of the print medium that often adversely affects image quality.

FIG. 1 illustrates a portion of the print medium 112 as the print medium passes over two rollers 108 that support the print medium in accordance with the prior art. During an inkjet printing process, the print medium can expand as the print medium absorbs water-based inks applied to it. When the direction of expansion is in a direction that is perpendicular to the direction of medium travel 100, it is often referred to as expansion in the crosstrack direction 102. Typically, the wrap of the print medium 112 around a roller 108 of an inkjet printing system produces sufficient friction between the print medium and the roller that the print medium is not free to slide in the crosstrack direction even though the print medium is expanding in that direction. This can result in localized buckling of the print medium away from the roller to create lengthwise ripples, also called flutes or wrinkles, in the print medium. Ridges or flutes 104 can be produced in the print medium 112 due to expansion of the print medium in the crosstrack direction 102 because the print medium cannot slip on the rollers 108. This wrinkling of the print medium during the printing process often leads to permanent creases forming in the print medium that ultimately affect image quality and are considered a print defect.

Multiple printheads are typically located and aligned by a support structure to form a linehead, with the linehead located over the print medium. In many such systems, the support structure of the linehead disposes the printheads in two or more rows; the rows disposed parallel to each other and aligned in the crosstrack direction. To prevent the print medium from fluttering, or vibrating up and down in the print zone, the print medium is supported by a roller that is aligned with the print line of each row of printheads. It is not uncommon for the bottom face of the support structure to become wet, either due to condensation from the moist air produced by the printing process or due to mist drops created by the print drops striking the print medium.

It has been found that, under some printing conditions, the flutes in the print medium are sufficiently tall that the top of the flutes can contact the bottom face of the support structure. When this occurs, the moist ink on the flutes can be smeared by the contact. Additionally, the moisture on the bottom of the support structure can be transferred to the print medium. The result is a degradation of the print quality. There remains a need in the art for a method of printing on a printing system that reduces the flutes or wrinkles in the print medium and prevents smearing of the ink from the medium coming into contact with the support structure of the lineheads.

SUMMARY OF THE INVENTION

According to an aspect of the invention, a method for printing on a moving print medium in a printing system includes providing a first linehead defining one or more print zones, the first linehead adapted to jet a liquid on a first side of the print medium in the one or more print zones, providing a plurality of transport rollers, wherein at least one transport roller is disposed opposite the first linehead, adjacent to a second side of the print medium, and is aligned with one of the print zones of the first linehead, providing a vacuum assembly having a vacuum manifold disposed opposite the second side of the print medium, wherein the vacuum manifold of the vacuum assembly is aligned with the aligned transport roller, moving the print medium through the printing system, applying a vacuum force proximate to the second side of the print medium such that at least a portion of the moving print medium is deflected thereby increasing a wrap angle of the moving print medium around the aligned transport roller, and jetting liquid from the first linehead onto the first side of the moving print medium to form a print.

Increasing the wrap angle of the print medium around the aligned transport roller has many advantages including preventing the print medium from fluttering or vibrating up and down in the print zone, limiting the smearing of wet ink on the print medium due to contact with the linehead or its support structure, and reducing the formation of flutes or wrinkles that can cause hard creases and other print defects in the print medium.

BRIEF DESCRIPTION OF THE DRAWINGS

In the detailed description of the example aspects of the invention presented below, reference is made to the accompanying drawings, in which.

DETAILED DESCRIPTION OF THE INVENTION

Figure 1:
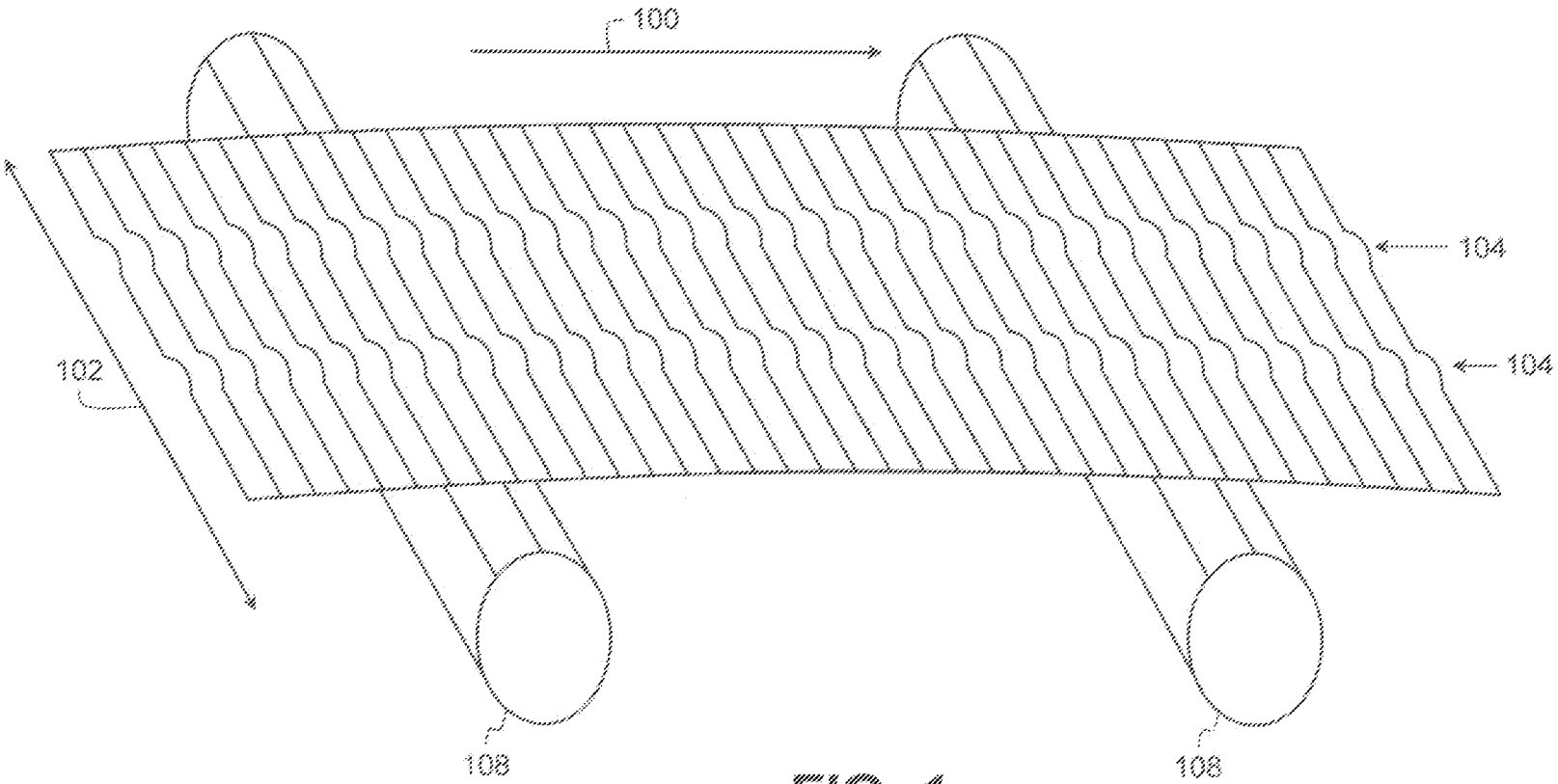
FIG. 1 (PRIOR ART)
FIG. 1 illustrates a portion of the print medium as the print medium passes over two rollers that support the print medium under each row of printheads in accordance with the prior art.

The present description will be directed in particular to elements forming part of, or cooperating more directly with, a web transport system. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example aspects of the present invention are illustrated schematically and not to scale for the sake of clarity. One of ordinary skill in the art will be able to readily determine the specific size and interconnections of the elements of the example aspects of the present invention.

As described herein, the example aspects of the present invention provide a printhead or printhead components typically used in inkjet printing systems. However, many other applications are emerging which use inkjet printheads to emit liquids that need to be finely metered and deposited with high spatial precision. Such liquids include inks, both water based and solvent based, that include one or more dyes or pigments. Other non-ink liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet printing is appropriate. For example, vinyl sheets, plastic sheets, textiles, paperboard, and corrugated cardboard can comprise the print medium. Additionally, although the term inkjet is often used to describe the printing process, the term jetting is also appropriate wherever ink or other liquid is applied in a consistent, metered fashion, particularly if the desired result is a thin layer or coating.

Inkjet printing is a non-contact application of an ink to a print medium. Typically, one of two types of ink jetting mechanisms are used and are categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting the print drops and the non-print drops, the print drops deflected onto the print medium, and catching the non-print drops. Various approaches for selectively deflecting drops have been developed including electrostatic deflection, air deflection, and thermal deflection.

The invention described herein is applicable to both types of printing technologies. As such, the terms printhead, linehead, and nozzle array, as used herein, are intended to be generic and not specific to either technology.

Additionally, there are typically two types of print medium used with inkjet printing systems. The first type is commonly referred to as a continuous web and the second type is commonly referred to as a cut sheet(s). The continuous web of print medium refers to a continuous strip of medium, generally originating from a source roll. The continuous web of print medium is moved relative to the inkjet printing system components via a web transport system, which typically include drive rollers, web guide rollers, and web tension sensors. Cut sheets refer to individual sheets of print medium that are moved relative to the inkjet printing system components via rollers and drive wheels or via a conveyor belt system that is routed through the inkjet printing system.

Aspects of the present invention are described herein with respect to an inkjet printing system. However, the term "printing system" is intended to be generic and not specific to inkjet printing systems. The invention is applicable to other types of printing systems, such as offset or traditional printing press technologies that print on a print medium as the print medium passes through the printing system.

The terms "upstream" and "downstream" are terms of art referring to relative positions along the transport path of the print medium; points on the transport path move from upstream to downstream. In FIGS. 2-5 the print medium moves in a direction indicated by print medium feed direction arrow 100. Where they are used, terms such as "first", "second", and so on, do not necessarily denote any ordinal or priority relation, but are simply used to more clearly distinguish one element from another.

Figure 2:
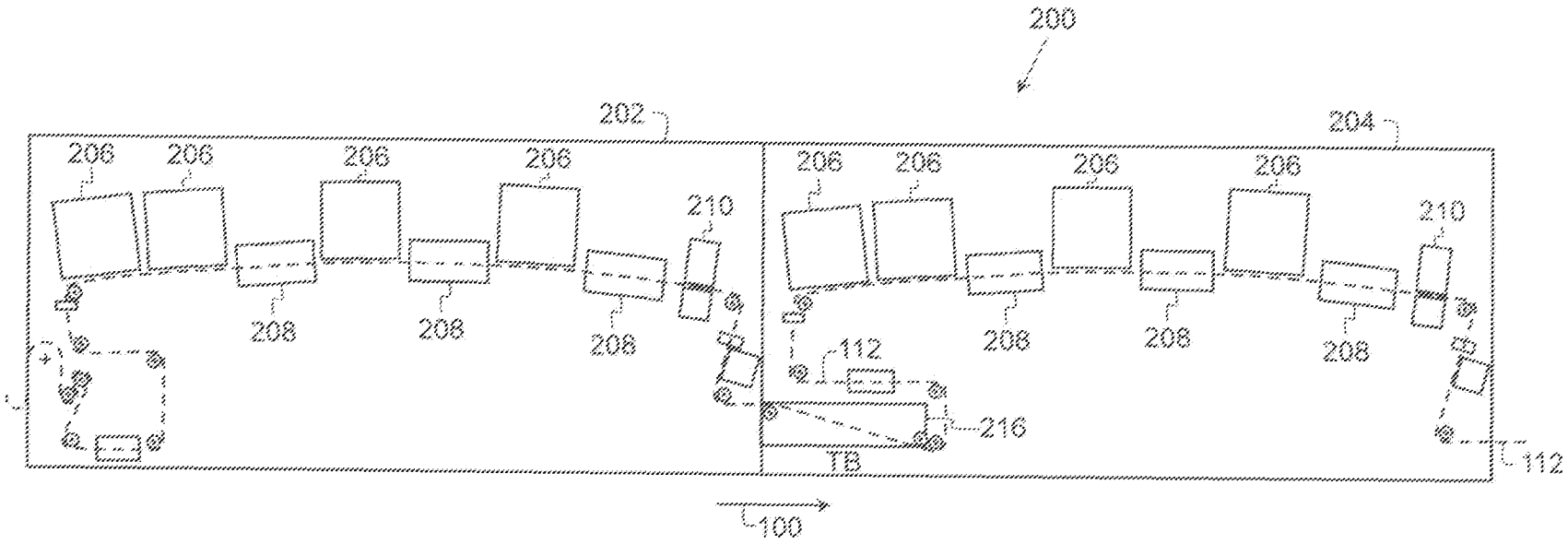
FIG. 2 (PRIOR ART)
FIG. 2 is a schematic side view of a printing system for continuous web printing on a print medium in accordance with the prior art.

Referring now to FIG. 2, there is shown a printing system 200 for continuous web printing on a print medium, as known in the art. The print medium 112 is continuous and the print medium passes through the printing system. The printing system 200 includes a first module 202 and a second module 204, each of which includes lineheads 206, dryers 208, and quality control sensors 210. The lineheads 206, dryers 208, and quality control sensors 210 are positioned opposite a first side of the print medium 112. In addition, the first module 202 and the second module 204 include a web tension system (not shown) that serves to physically move the print medium 112 through the printing system 200 in the feed direction denoted by arrow 100 (left to right in the figure).

The print medium 112 enters the first module 202 from a source roll (not shown). The print medium 112 is supported and guided through the printing system by rollers without the need for a transport belt to guide and move the print medium through the printing system. The linehead(s) 206 of the first module applies ink to the first side of the print medium 112. As the print medium 112 feeds into the second module 204, there is a turnover mechanism 216 which inverts the print medium 112 so that linehead(s) 206 of the second module 204 can apply ink to the second side of the print medium 112. The print medium 112 then exits the second module 204 and is collected by a print medium receiving unit (not shown).

Figure 3:
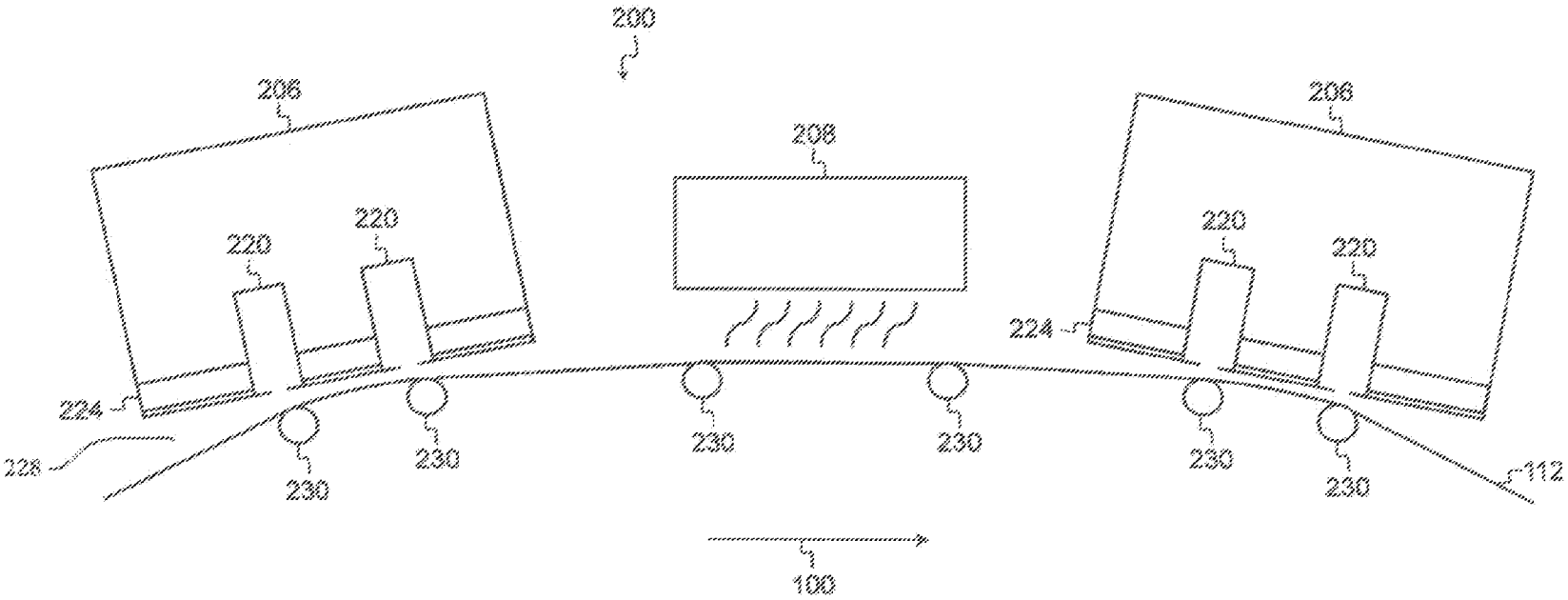
FIG. 3 (PRIOR ART)
FIG. 3 depicts a portion of the printing system 200 shown in FIG. 2 in more detail.

FIG. 3 depicts a portion of the prior art printing system in more detail. As the print medium 112 is directed through the printing system 200, the lineheads 206, which typically include printheads 220, apply ink or another liquid via the nozzle arrays of the printheads 220. The printheads 220 within each linehead 206 are located and aligned by a support structure 224. After the ink is jetted onto the print medium 112, the print medium 112 passes beneath the dryer 208, which applies heat to the print medium to dry the ink.

As the ink applied to the print medium 112 dries by evaporation, the humidity of the air above the print medium 112 rises in the clearance gap 228 between the printer components (for example, lineheads 206 and dryers 208) and the print medium 112. To prevent the print medium that is opposite the lineheads 206 from fluttering and contacting the support structure 224, the print medium 112 is supported by transport rollers 230 that are aligned with a print line of each row of printheads.

Figure 4:
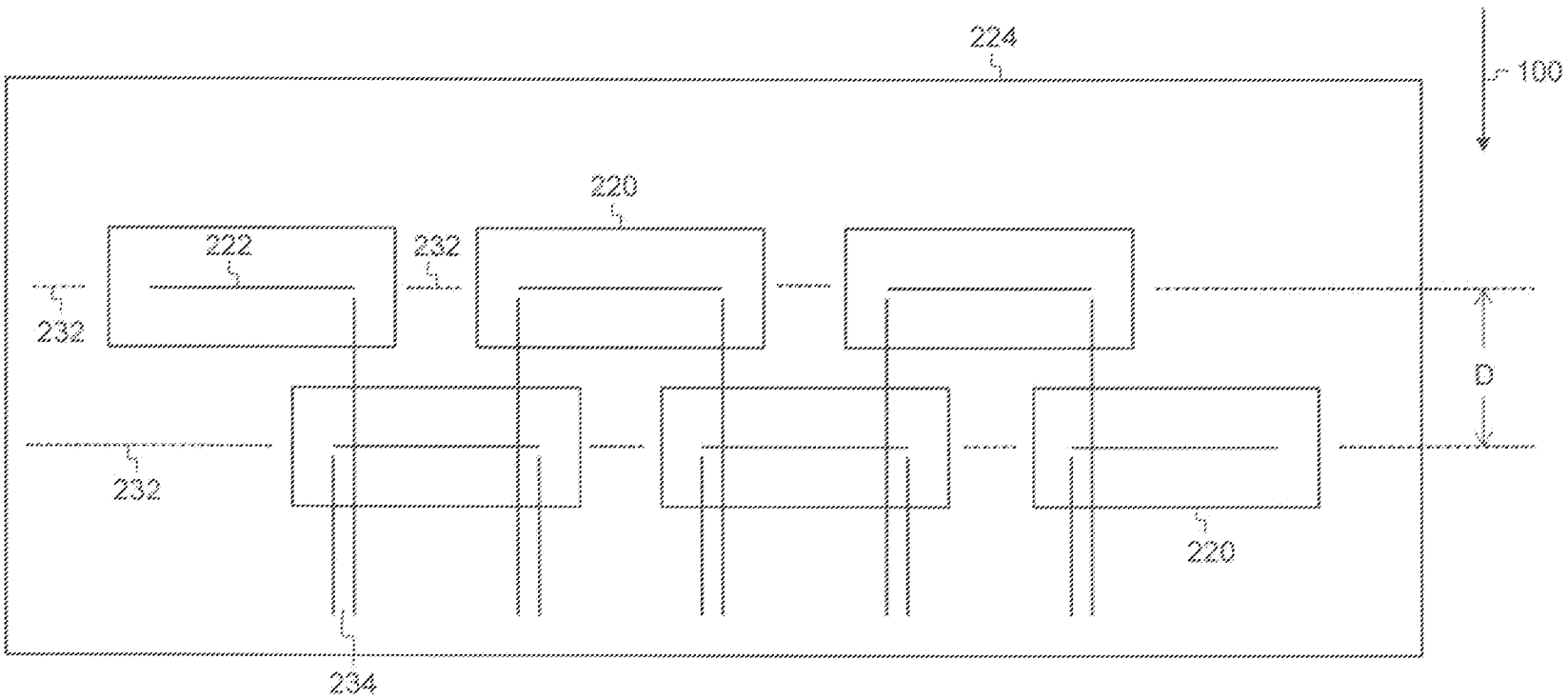
FIG. 4 (PRIOR ART)
FIG. 4 illustrates an example of an arrangement of the printheads in a linehead in accordance with the prior art.

Referring now to FIG. 4, there is shown an example of an arrangement of printheads 220 in a linehead 206 according to the prior art. A face of the support structure 224 that is adjacent to the print medium 112 is shown. The printheads 220 are aligned in two or more rows in a staggered formation. The nozzles arrays 222 of the printheads in each row of printheads 220 lie along a line, called a print line 232, which is parallel to the crosstrack direction and perpendicular to the direction of motion of the print medium denoted by the arrow 100. The nozzle array 222 of each printhead is also aligned along the crosstrack direction. The print lines 232 for the rows of nozzle arrays 222 are spaced apart by a distance D. The ends of the nozzle arrays 222 of the printheads in one row overlap with the ends of the nozzle arrays of printheads in the other row(s) to produce overlap regions 234. The overlap regions 234 enable the print from overlapped printheads 220 to be stitched together without a visible seam through the use of appropriate stitching algorithms that are known in the art. As described earlier, a transport roller 230 (FIG. 3) is aligned with a respective print line of each row of printheads to prevent the print medium from fluttering at each of the print lines 232.

Figure 5:
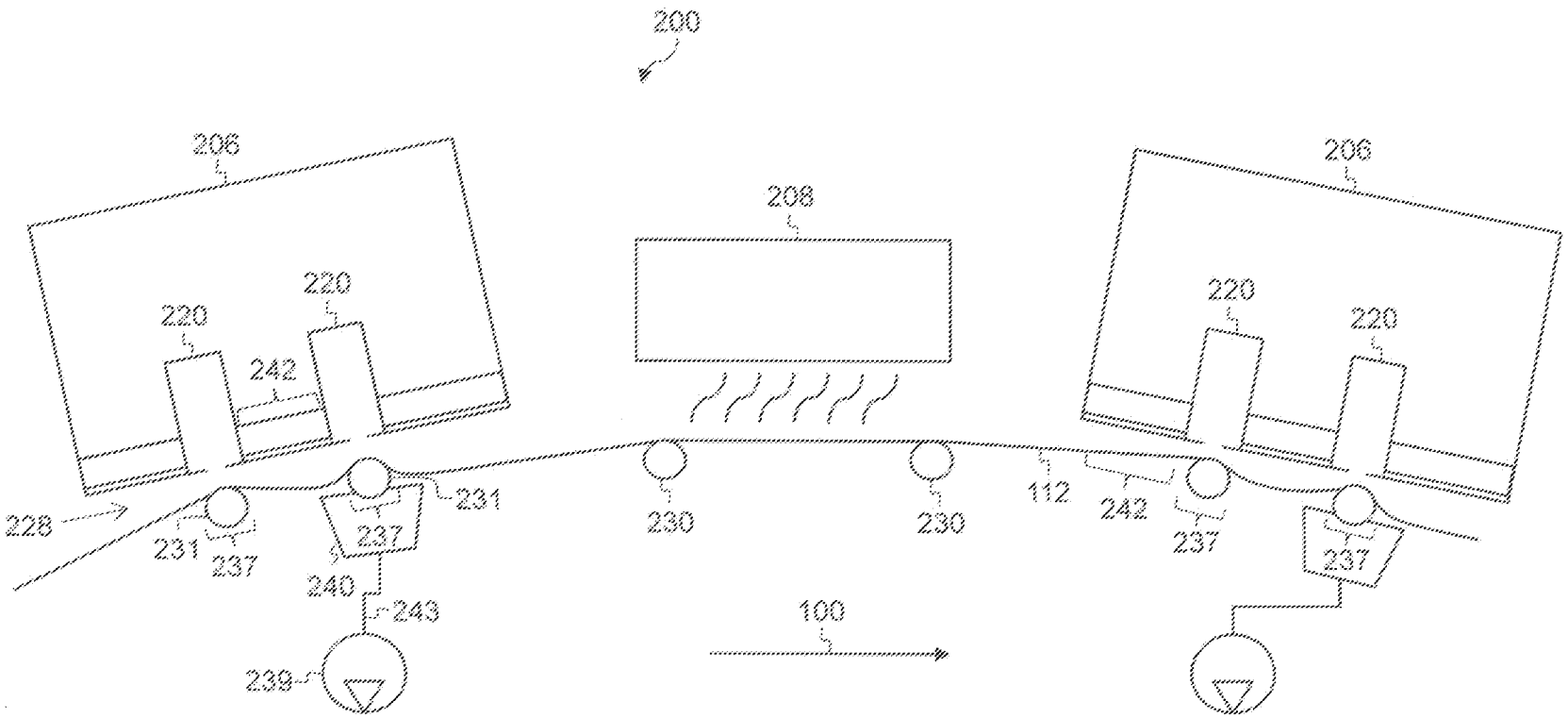
FIG. 5 is a schematic side view of a portion of a printing system that includes a vacuum assembly in an aspect of the invention.
Figure 6:
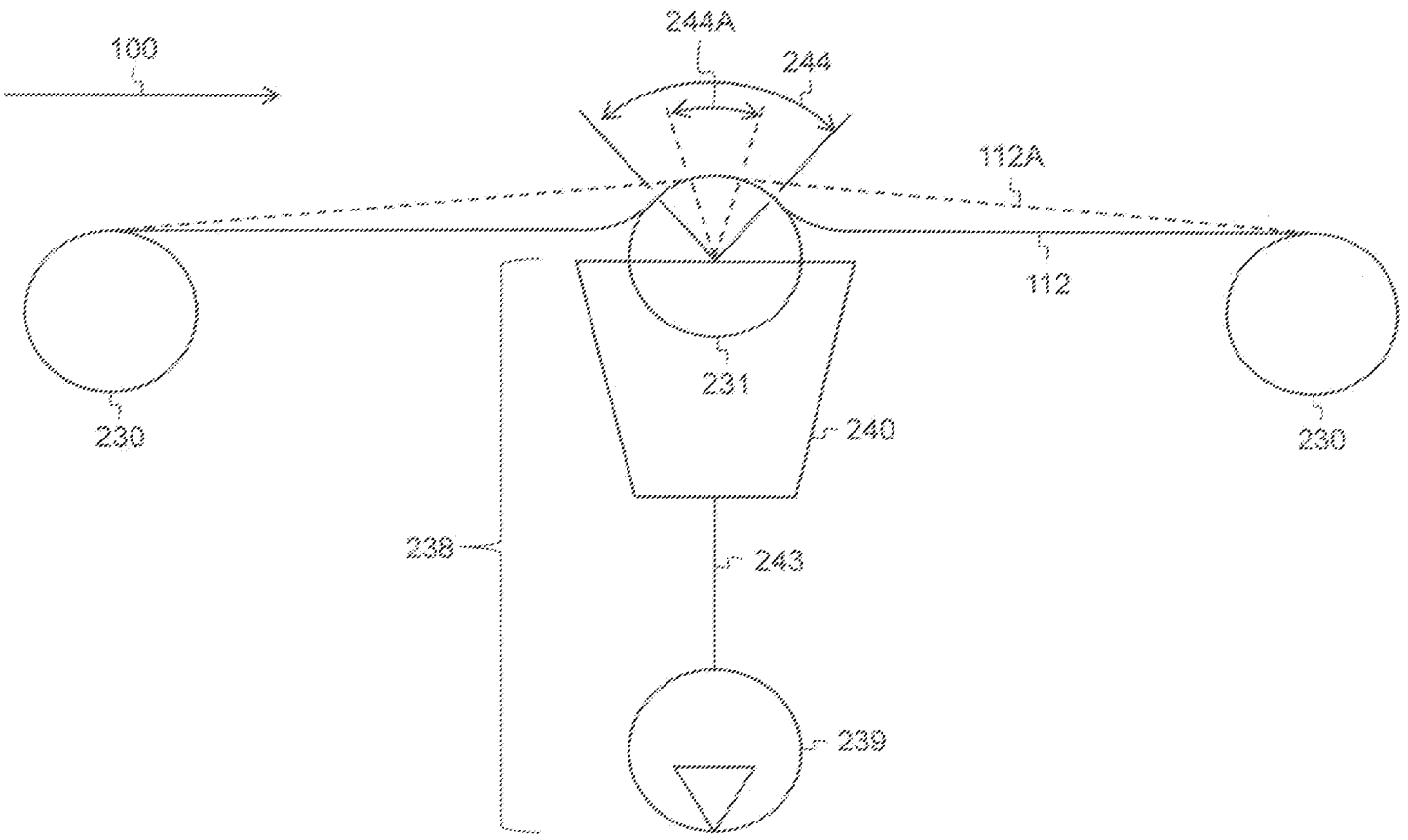
FIG. 6 depicts a portion of FIG. 5 that includes a vacuum assembly in more detail.

FIG. 5 is a schematic side view of a portion of a printing system 200 using vacuum assist to pull down the print medium 112 onto the transport rollers 230. The printing system includes a first linehead 206 disposed opposite a first side of a print medium 112. The first linehead 206 has one or more print zones 237 where a liquid is deposited onto the first side of the print medium. The first linehead can also include one or more non print zones 242 where no liquid is deposited onto the print medium. The printing system also includes one or more transport rollers 230, where at least one transport roller is disposed opposite the first linehead 206. The transport roller is also adjacent to the second side of the print medium 112, and is aligned with a respective print zone 237 of the first linehead. Such transport rollers 230 that are aligned with one of the print zones of a linehead are commonly referred to as aligned transport rollers 231. A vacuum manifold 240 is disposed opposite a second side of the print medium and is aligned with a print zone 237 of the first linehead. The vacuum manifold 240 outputs a vacuum force proximate to the second side of the print medium such that at least a portion of the print medium 112 is deflected away from the first linehead 206 and towards the aligned transport roller 231. The vacuum force increases the wrap of the print medium around the transport roller so that the wrap angle 244 is increased. The wrap angle 244 is the angle around the aligned transport roller 231 subtended by the print medium 112 in contact with the roller, as shown in FIG. 6. The wrap angle of the print medium around the aligned transport roller with a vacuum activated is greater than the wrap angle of the print medium around the aligned transport roller without the use of the vacuum force.

Figure 15:
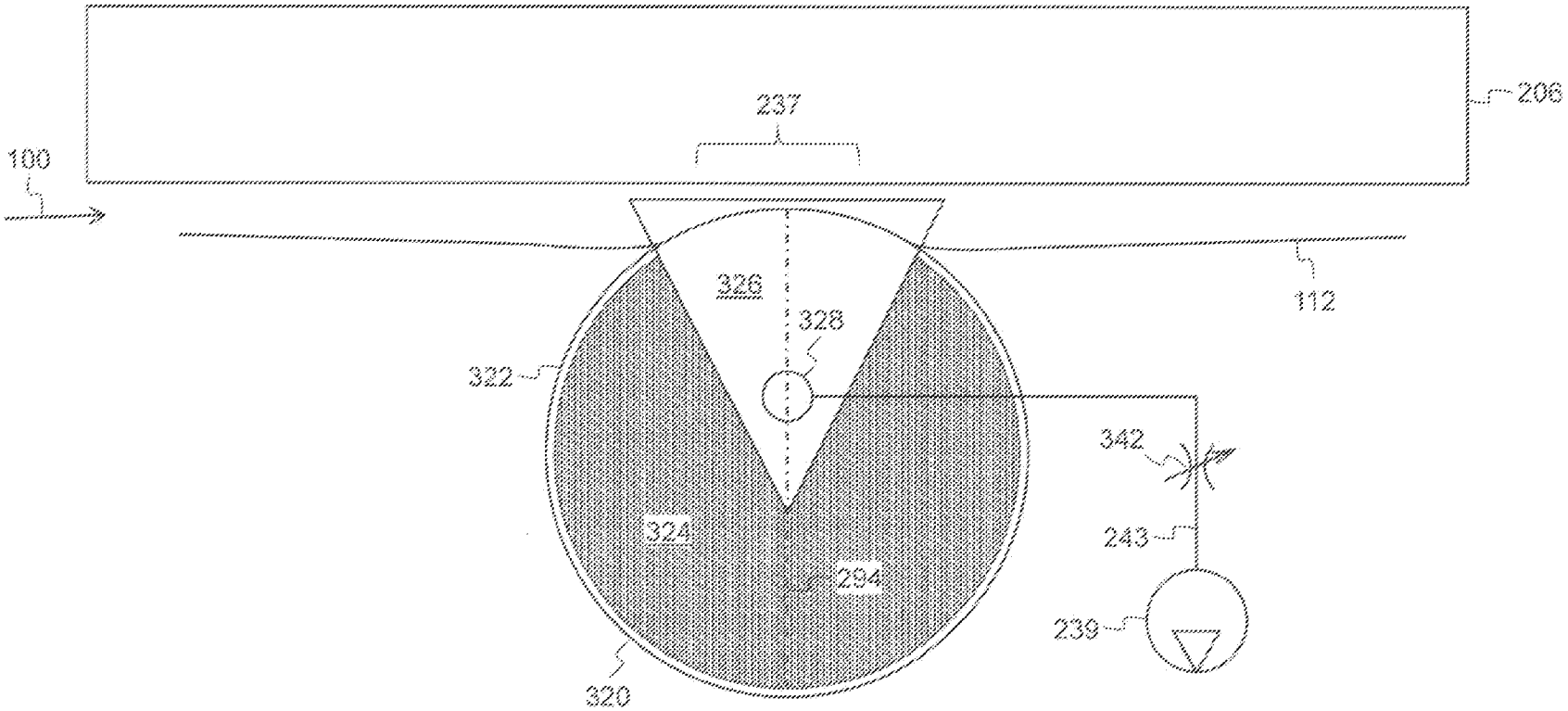
FIG. 15 is a schematic side view of a portion of a printing system that includes a symmetrical vacuum transport roller in an aspect of the invention.

The printing system can include a vacuum source 239 as shown in FIG. 5. The vacuum source 239 is fluidically coupled to the vacuum manifold 240 by a vacuum duct 243. A single vacuum source can be used to provide a vacuum force to multiple vacuum manifolds located along the transport path of the print medium as shown in FIG. 15. Additionally, the vacuum source can be located remotely from the printing system, such as a house vacuum system, which is connected to the one or more vacuum manifolds of the printing system by means of vacuum ducts.

FIG. 6 shows a side view of a three roller section of a print medium path over which the print medium 112 passes. Adjacent to the aligned transport roller 231 is a vacuum assembly 238, which includes a vacuum manifold 240, a vacuum source 239, and a vacuum duct 243 that connects the vacuum source to the vacuum manifold. When the vacuum source 239 is not energized, the print medium is indicated by the dashed line 112A. With the vacuum source 239 energized, the vacuum in the vacuum manifold 240 creates a downward force on the portion of the print medium above vacuum manifold. This downward vacuum force on the print medium deflects the print medium downward toward the center transport roller as indicated by solid line showing print medium 112. As a result of this downward force, the print medium maintains contact with the roller for a larger arc of the roller. The wrap angle 244A is the angle around the aligned transport roller 231 subtended by the print medium contacting with the roller when the vacuum source 239 is not energized. The wrap angle 244, corresponding to the vacuum acting on the print medium, is larger than the wrap angle 244A corresponding to the vacuum manifold not acting on the print medium.

Figure 7:
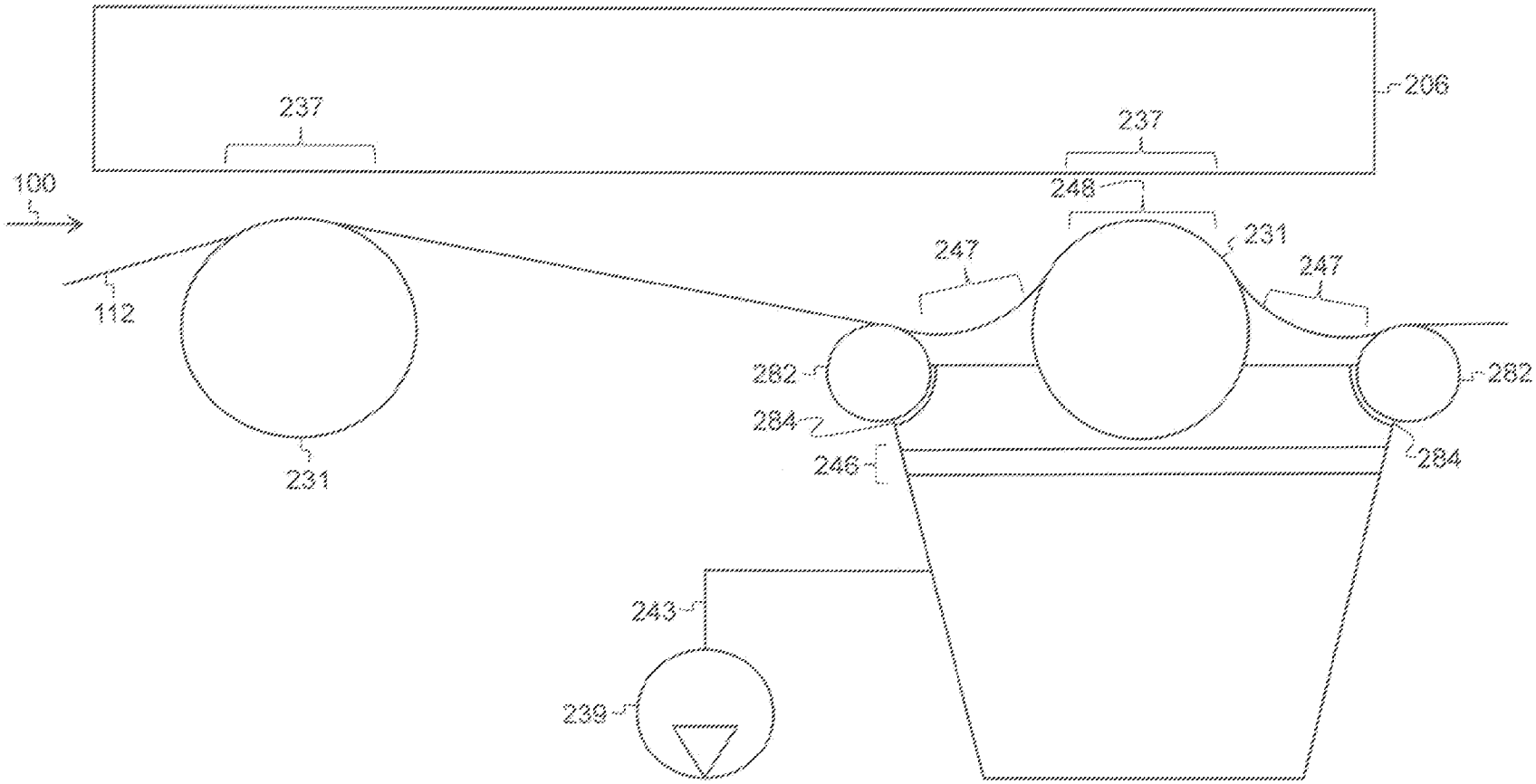
FIG. 7 is a schematic side view of a portion of a printing system that includes a plurality of transport rollers with or without a vacuum assembly in an aspect of the invention.

FIG. 7 shows two aligned transport rollers 231 supporting a print medium 112 as it passes under a linehead 206. The print medium feed direction is denoted by the arrow 100. The first side of the print medium 112 faces the linehead 206 so it can be printed on by the linehead. The rollers are aligned transport rollers 231 and each roller is aligned with a print zone 237 of the linehead. The aligned transport rollers 231 contact the second side of the print medium 112. In this aspect of the invention, the vacuum manifold 240 is aligned with one of the print zones 237 of the linehead, opposite the second side of the print medium 112. and is disposed such that the vacuum manifold encompasses the aligned transport roller 231. In this aspect, there is no vacuum manifold disposed in alignment with the other aligned transport roller 231.

The vacuum of the vacuum manifold 240 outputs a vacuum force proximate to the second side of the print medium which causes the print medium to be deflected away from the linehead 206 and toward the aligned transport roller 231, thereby increasing the wrap angle of the print medium around the aligned transport roller 231. The deflection of the print medium away from the linehead 206 provides additional clearance between the print medium 112 and the linehead 206. The vacuum force acting on the print medium 112 causes the print medium to have regions of upward curvature 247 on each side of the aligned transport roller. Between these two regions of upward curvature 247, the print medium has a region of downward curvature 248 as it passes over the aligned transport roller 231. The alternating regions of upward and downward curvature, 247 and 248, serve to stiffen the print medium so that it is less likely to form flutes aligned with the direction of medium travel. In the aspect of the invention shown in FIG. 7, a vacuum manifold is aligned only with the downstream print zone of the linehead. This is to illustrate that a second vacuum manifold is not necessary for a second print zone of a linehead if there is little risk of fluting and if there is sufficient wrap of the print medium around the transport roller aligned with the second print zone to avoid print medium flutter in that print zone.

The aspect of the invention shown in FIG. 7 provides a vacuum seal between the print medium 112 and the long leading and trailing edges of the vacuum manifold 240 using sealing rollers 282. The print medium 112 contacts the sealing rollers, so there is no gap between the print medium and the sealing roller through which air can flow into the vacuum manifold. These sealing rollers rotate with the moving print medium so there is no scuffing of the print medium against the sealing rollers. In the aspect of the invention shown in FIG. 7, there is an extended airflow gap 284 between the wall of the vacuum manifold 240 and the sealing rollers 282. The presence of the airflow gap 284 between the vacuum manifold 240 and the sealing rollers 282 permits the sealing rollers 282 to rotate freely as the print medium 112 moves over the sealing rollers 282. By extending the airflow gap 284, so that the gap extends along a considerable portion of the circumference of the sealing rollers 282, the flow impedance to airflow through that gap is sufficiently high that airflow into the vacuum manifold 240 can be maintained at acceptable levels. By way of example only, the extended airflow gap 284 wraps around approximately ¼ of the circumference of the sealing rollers 282.

Figure 8:
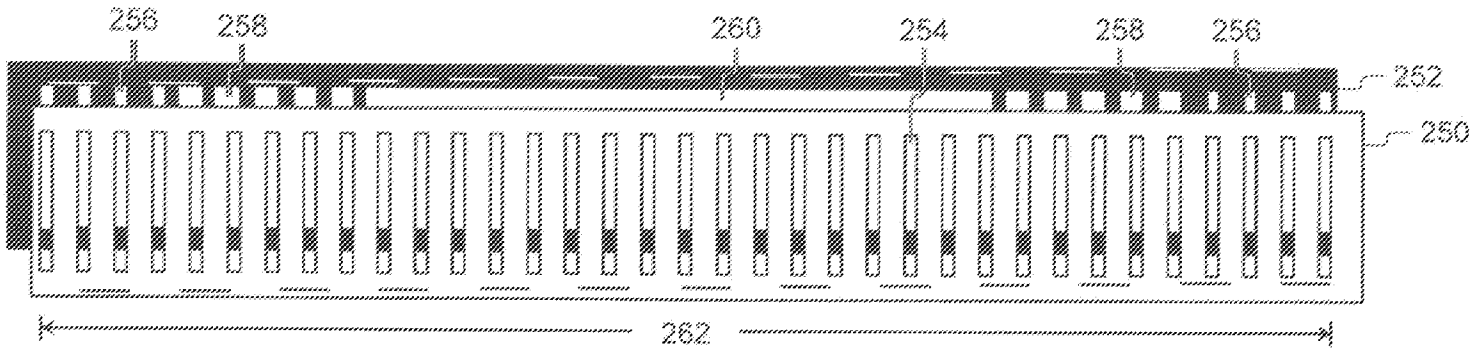
FIGS. 8-10 illustrate an example of an adjustment structure for a vacuum manifold in an aspect of the invention.
Figure 9:
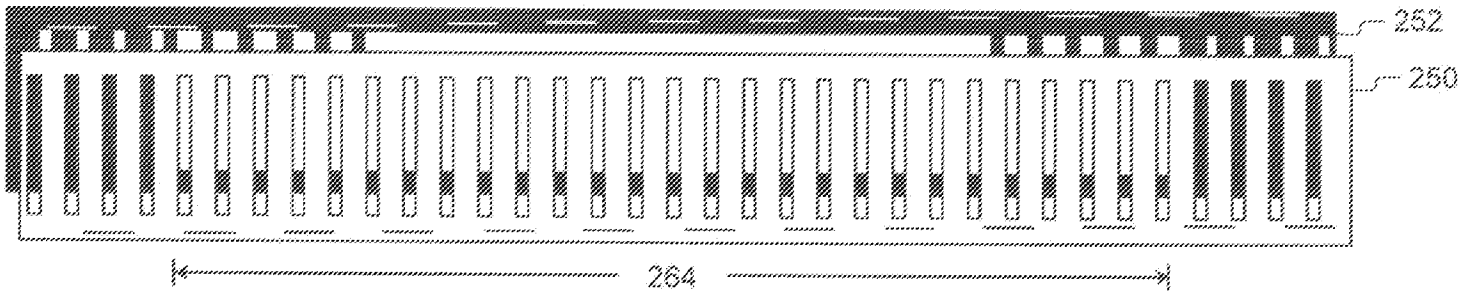

To adjust the effective width of the vacuum manifold 240 so that the effective width corresponds to the width of the print medium, the vacuum assembly 238 can include an adjustment structure 246. The vacuum manifold 240 can include the adjustment structure 246 or the adjustment structure 246 can be disposed above the vacuum manifold 240. FIGS. 7-9 illustrate one example of an adjustment structure for a vacuum manifold. In the illustrated example, the adjustment structure includes a sliding cover 250 in combination with a fixed cover 252. The sliding cover 250 has been displaced downward from the intended position in FIGS. 7-9 to enable a portion of the structure of the underlying fixed cover 252 to be visible. The sliding cover 250 includes a first array of apertures 254 formed through the sliding cover 250. The apertures in the first array of apertures 254 are evenly spaced down the length of the sliding cover 250 and are of a uniform size. As an example, the center to center spacing of the apertures in the first array of apertures 254 is three times the width of the apertures 254.

At each end of the fixed cover 252 is a second array of apertures 256. The second array of apertures 256 has the same size and spacing as the apertures in the first array of apertures 254. The second array of apertures 256 extend down only a portion of the length of the fixed cover 252 in the illustrated example.

Inboard of the second array of apertures 256 at each end of the fixed cover 252 is a third array of apertures 258. The center to center spacing of the apertures in the third array of apertures 258 can be the same as, or different than, the spacing for the apertures in the second array of apertures 256. But the apertures in the third array of apertures 258 each have different width, for example twice the width, than the apertures in the second array of apertures 256, as illustrated in FIG. 8.

The center portion of the fixed cover 252 can include a single aperture 260. When the sliding cover 250 is positioned laterally in a first position relative to the fixed cover 252, as depicted in FIG. 8, the apertures in the first array of apertures 254 in the sliding cover 250 align with the single aperture 260 and with the apertures in the second and third array of apertures 256, 258 in the fixed cover 252. The first position of the sliding cover relative to the fixed cover permits air to be drawn into the vacuum manifold across width 262. In this arrangement, air is drawn through substantially all of the apertures 254 in the sliding cover 250.

Shifting the sliding cover 250 laterally to a second position shown in FIG. 9 causes the apertures in the first array of apertures 254 in the sliding cover 250 to be aligned only with the single aperture 260 and with the apertures in the third array of apertures 258. The apertures in the first array of apertures do not align with the apertures in the second array of apertures 256 in the fixed cover 252. Air is drawn into the vacuum manifold through the portion of the apertures 254 in the sliding cover 250 across width 264. The size of width 264 is smaller than the size of width 262, so less air is drawn into the vacuum manifold.

Figure 10:
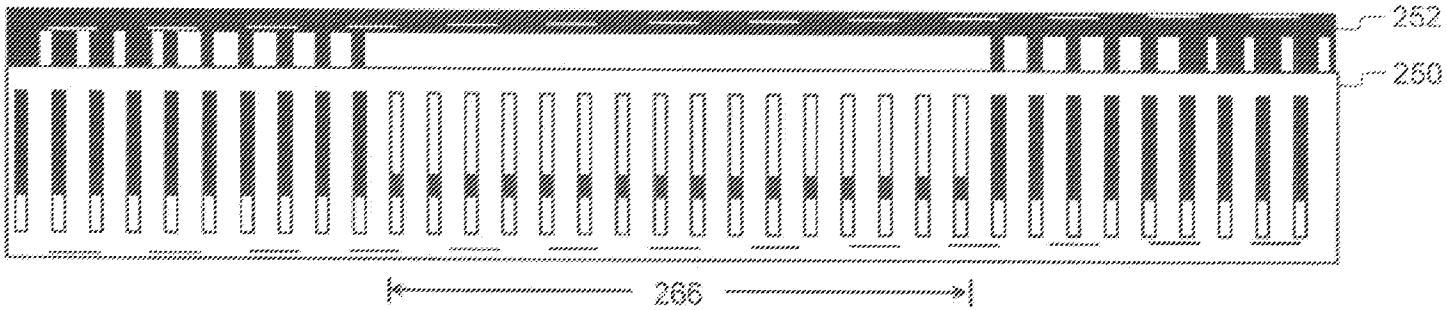

Finally, when the sliding cover 250 is positioned laterally in a third position with respect to the fixed cover 252, as shown in FIG. 10, the apertures in the first array of apertures 254 in the sliding cover 250 align only with the single aperture 260 of the fixed cover 252. The third position permits air to be drawn into the vacuum manifold across width 266. Air is drawn through the portion of the apertures in the first array of apertures 254 that align with the single aperture in the fixed cover 252. The size of width 266 is smaller than the size of width 264 and width 262, so less air is drawn into the vacuum manifold.

The sliding cover 250 can be positioned at more than three positions with respect to the fixed cover. The combination of the sliding cover 250 and the fixed cover 252 provides a mechanism for adjusting the effective width of the vacuum manifold to different widths. The sliding cover can be actuated using mechanical means or electrically controlled actuators. The adjustable effective width permits the vacuum force to be applied uniformly across different widths of print medium. When the sliding cover is positioned at the first position (see FIG. 8) the system can apply a vacuum force uniformly across a wider width of print medium. When the sliding cover is positioned at the second or third position (see FIGS. 8 and 9), the system can apply a vacuum force uniformly across narrower widths of print medium. The smaller effective widths provided by the combination of the sliding and fixed covers can avoid ineffective air draw around the side of narrower print medium when the sliding cover 250 is positioned in the second or third positions.

The sliding cover and the fixed cover can be made of a material, or coated with a material, that is non-wetting to the inks used in the printing system. By way of example only, the materials can be selected to be hydrophobic for water based inks. The non-wetting nature of the materials inhibits ink from wicking into the gap that separates the fixed and sliding covers, where the ink can dry and inhibit the sliding of the sliding cover.

The adjustment structure is not limited to the combination of a fixed cover and a sliding cover. Any mechanism that allows for adjusting the effective width of the vacuum manifold can be used. For example, a manifold that includes end walls that are movable to allow the length of the vacuum manifold to be adjusted can be used, such as are described in U.S. Patent Application No. 61/706,185, filed Sep. 27, 2012 titled Vacuum Pulldown Of Web Edges In Printing Systems, commonly assigned. In this aspect of the invention, seals can be used to prevent air from leaking around the movable end walls and the non-movable side and bottom walls of the manifold. The vacuum manifold can also include one or more actuators for adjusting the spacing between the end walls.

The spacing between the vacuum manifold and the print medium can be adjustable to accommodate different types of print medium. The vacuum source can also be adjustable to accommodate different types of print medium. For example the vacuum source can be adjusted to provide a stronger vacuum force for use with thicker substrates than is used for thinner substrates. The adjustment mechanism can include a control to adjust the speed of the vacuum pump, an adjustable flow restrictor on the duct between the vacuum source and the vacuum manifold, an adjustable flow restrictor in the exhaust of the vacuum source, or an adjustable air bleed to introduce air into the duct between the vacuum manifold and the vacuum source, or any other mechanism.

Figure 11:
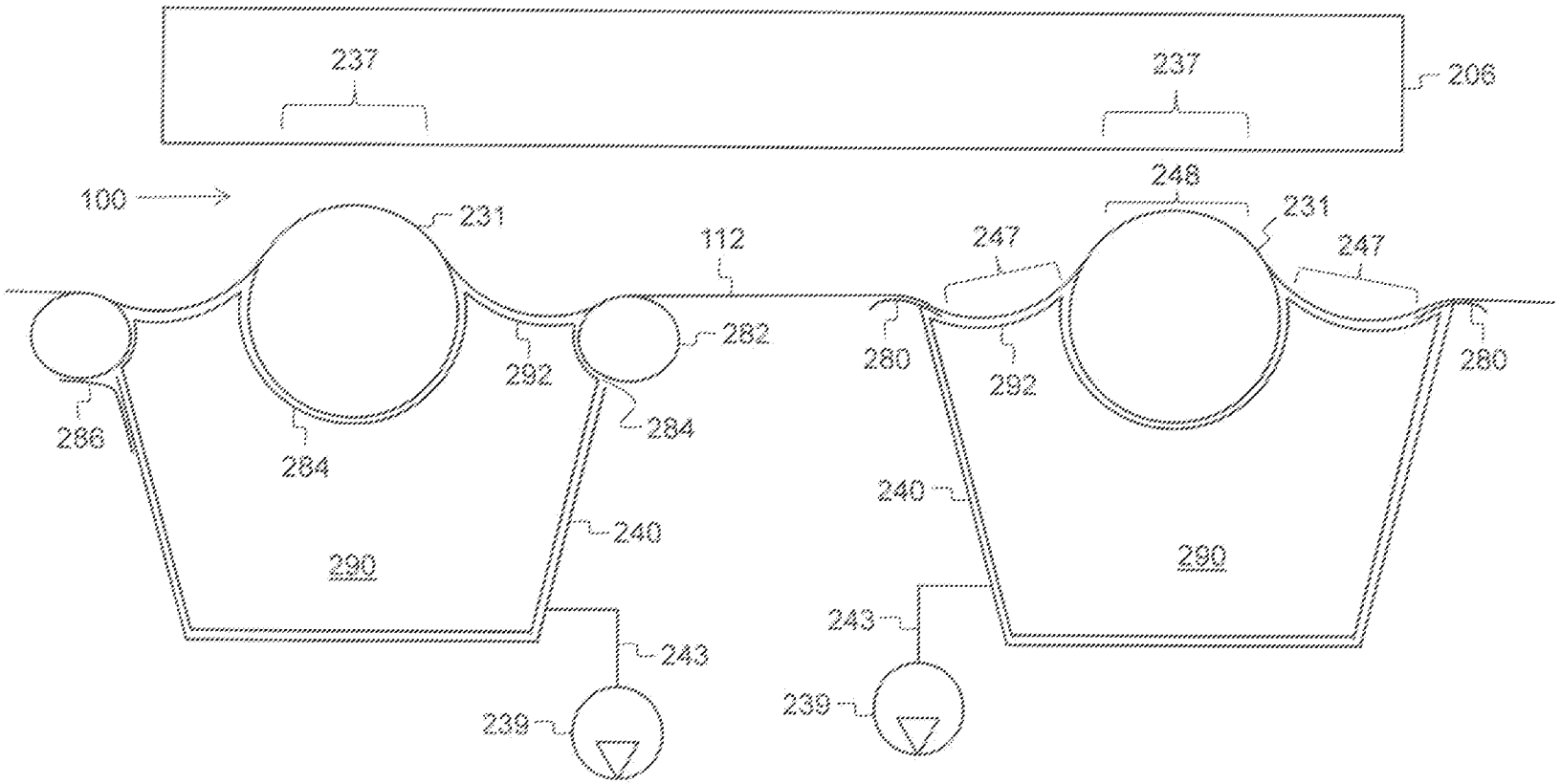
FIG. 11 is a schematic side view of a portion of a printing system that includes two transport rollers with vacuum assemblies in an aspect of the invention.

As shown in FIG. 11, the printing system can include a plurality of transport rollers, where some of the aligned transport rollers 231 are aligned with the print zone of the first linehead 206. The printing system further includes a plurality of vacuum manifolds 240. Each vacuum manifold 240 partially surrounds the aligned transport roller 231 and includes at least one opening on either side of the aligned transport roller 231 that causes the vacuum to operate through the openings on the print medium 112. The vacuum manifold on the right illustrates the use of skid pads 280 which are disposed adjacent to the second side of the print medium 112 and laterally adjacent to the vacuum manifold, along the leading and trailing edges of the vacuum manifold 240. Skid pads 280 are formed on or attached to the upstream or downstream walls of the vacuum manifold 240. The skid pads 280 can be positioned to serve as support surfaces for the print medium. The print medium 112 slides across the skid pads 280 once the print medium is pulled down by the vacuum in the vacuum manifold 240. By so doing, the skid pads provide an air seal between the upstream and the downstream walls of the vacuum manifold 240 and the print medium 112, to limit the amount of air drawn into the vacuum manifold. The skid pads 280 can be formed of, or coated with, a material that has a low coefficient of friction and a high abrasion resistance. One such material is ultra-high-molecular-weight polyethylene. The skid pads 280 can be formed as curved plate or sheets or can be in the form of non-rotating rods over which the print medium slides. Various aspects of the invention can include any number of skid pads. Additionally, the skid pads do not have to be formed on or attached to the walls of the vacuum manifold 240. The side pads can be positioned in the non-print zone 242 between the walls of the vacuum manifold 240 and the aligned transport rollers 231.

This aspect of the invention includes movable end walls 290 as an adjustment structure 246 for adjusting the effective width of the vacuum manifold for the width of the print medium 112. These walls are typically positioned to align with the edges of the print medium. The upper surfaces 292 of the movable end walls serve as skid pads to support the edges of the print medium 112. These end wall skid pads can include a vacuum port through which vacuum can be applied to the edges of the print medium to hold the edges of the print medium in contact with the contact surface of the end walls as described in U.S. Patent Application No. 61/706,185, filed Sep. 27, 2012 titled Vacuum Pulldown Of Web Edges In Printing Systems, commonly assigned. The upper surfaces of the end walls are contoured to have an upward curvature to match the contour of the print medium in the central portion of the vacuum manifold produced by the vacuum force acting on the print medium. This enables the print medium 112 to have uniform upward curvature across the full width of the print medium. To enable the aligned transport roller 231 and the sealing rollers 282 to rotate, the movable end walls should provide clearance between the end walls and the rollers. To limit the flow of air into the vacuum manifold through these airflow gaps 284, the end walls can be thick, extending parallel to the roller, so that the flow impedance created by the long thin extended gap limits the flow of air into the vacuum manifold to an acceptable level.

The side walls of the manifold can also include an array of grooves into which the end walls can be positioned. When a different width of print medium is to be used, the effective width of the vacuum manifold in the crosstrack direction can be adjusted by manually shifting the end walls from one set of grooves to another. Additionally, the width of the manifold can be adjustable from one side of the medium transport. On a printing system in which the print medium is center justified on the rollers, a single adjustment device can adjust both end walls of the vacuum manifold at the same time. By way of example only, the end walls can each be moved by a lead screw in which the thread rotation is reversed from one side of the centerline to the other, such that a rotation of the lead screw causes end walls to move either both toward the center of the manifold or both away from the center of the vacuum manifold depending of the direction of rotation of the lead screw. The two end caps can be solid members that ride against a solid lower vacuum chamber plate that extending inward and sealed against the outside edges of the plenum. By clamping down the movable end caps against the lower base the area of the vacuum manifold, air leakage past the end walls can be eliminated.

The left vacuum manifold 240 of FIG. 11 is disposed opposite a second side of the print medium 112 and is aligned with the aligned transport roller 231 aligned with the left print zone of the linehead. The vacuum manifold outputs a vacuum force proximate to the second side of the print medium 112 such that at least a portion of the print medium is deflected away from the linehead 206 and towards the aligned transport roller 231 thereby increasing the wrap angle of the print medium around the aligned transport roller. This manifold aspect of the invention, like that in FIG. 7 includes sealing rollers 282, which serve as support surfaces that are positioned laterally adjacent to the vacuum manifold 240 for limiting the flow of air into the vacuum manifold by providing a vacuum seal between the print medium and the leading and trailing edges of the vacuum manifold. The sealing rollers 282 are positioned in the non-print zone 242 and are recessed below the plane or level defined by the contact of the print medium 112 with the top of the two transport rollers 230. The sealing rollers 282 support the print medium 112 to create an air seal between the sealing rollers 282 and the print medium 112.

The print medium 112 contacts the sealing rollers, so there is no gap between the print medium and the sealing roller through which air can flow into the vacuum manifold. As the sealing rollers 282 can rotate as the print medium moves over each sealing roller, the surface speed of the sealing rollers matches the speed of the print medium. As these sealing rollers rotate with the moving print medium, there is no scuffing of the print medium against the sealing rollers. To enable the sealing rollers 282 to rotate, an airflow gap 284 is required between these roller and the walls of the vacuum manifold. To limit the airflow into the vacuum manifold 240 through the airflow gap 284, the airflow gap has an extended length. The airflow gap is shown as an extended airflow gap, having a narrow gap that provides an extended length of opening through which air leaking into the vacuum manifold may flow. The extended length of the airflow gap through which leakage air may flow combined with narrowness of the airflow gap provides sufficient flow impedance to limit the flow rate of air entering the vacuum manifold. Some aspects of the invention include a flexible polymeric blade 286 attached to the vacuum manifold which provides a sliding seal to the sealing rollers 282 to further reduce the airflow into the vacuum manifold.

Figure 12:
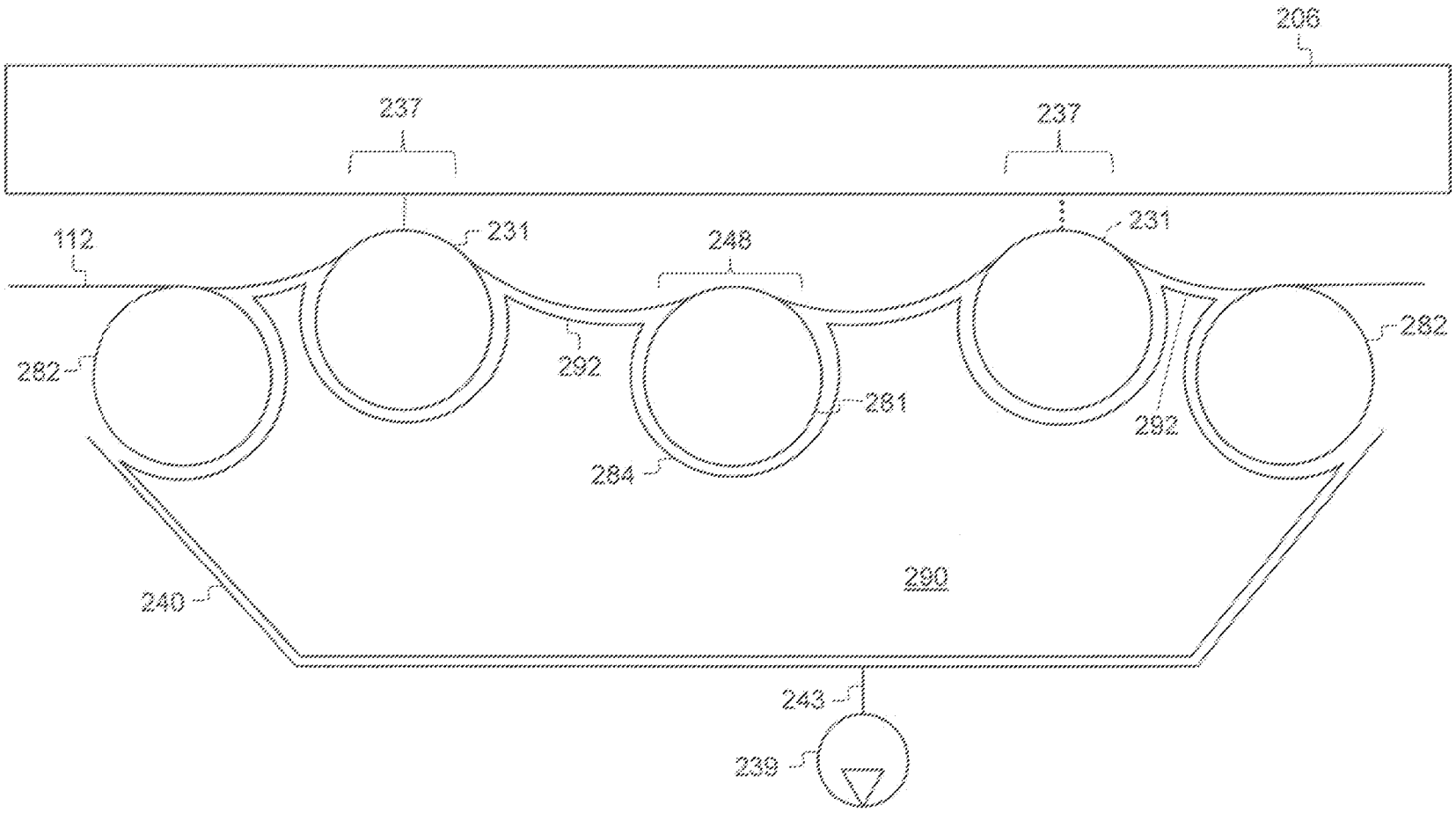
FIG. 12 is a schematic side view of a portion of a printing system that includes multiple transport rollers aligned to a single vacuum assembly in an aspect of the invention.

FIG. 12 illustrates an aspect of the invention in which a single vacuum manifold 240 provides vacuum to act on the print medium 112 passing over two aligned transport rollers 231 associated with a linehead 206. In this aspect of the invention sealing rollers 282 provide the seals between the print medium 112 and the vacuum manifold 240 along the leading and trailing edges of the vacuum manifold. The vacuum manifold also includes a guide roller 281 between the two aligned transport rollers 231. The guide roller supports the print medium 112 so that the print medium isn't sucked too deeply into the vacuum manifold by the applied vacuum. This guide roller 281 adds an additional region of downward curvature between the aligned transport rollers 231; the added downward curvature region 248 between two upward curvature non print zone regions 247 enhances the stiffness of the print medium 112 to resist the formation of flutes parallel to the print medium transport direction. The sealing rollers 282 and the guide roller 281 can be spaced further apart from the linehead 206 than the aligned transport rollers 231 to provide additional clearance between the linehead and the print medium in these regions. Movable end walls 290 can be used to adjust the effective width of the vacuum manifold to accommodate different widths of print medium. These end walls are similar to the movable end walls described for earlier aspects of the invention, but now they may also provide clearance around the guide roller 281 in addition to the aligned transport rollers 231, and the sealing rollers 282. As with the previous aspects of the invention, extended length airflow gaps 284 can be used to limit the amount of air flowing into the vacuum manifold 240 through the airflow gaps around each of the rollers. The upper surfaces 292 of the end wall 290 are contoured to match the upward curvature of the print medium across the width of the vacuum manifold.

Figure 13:
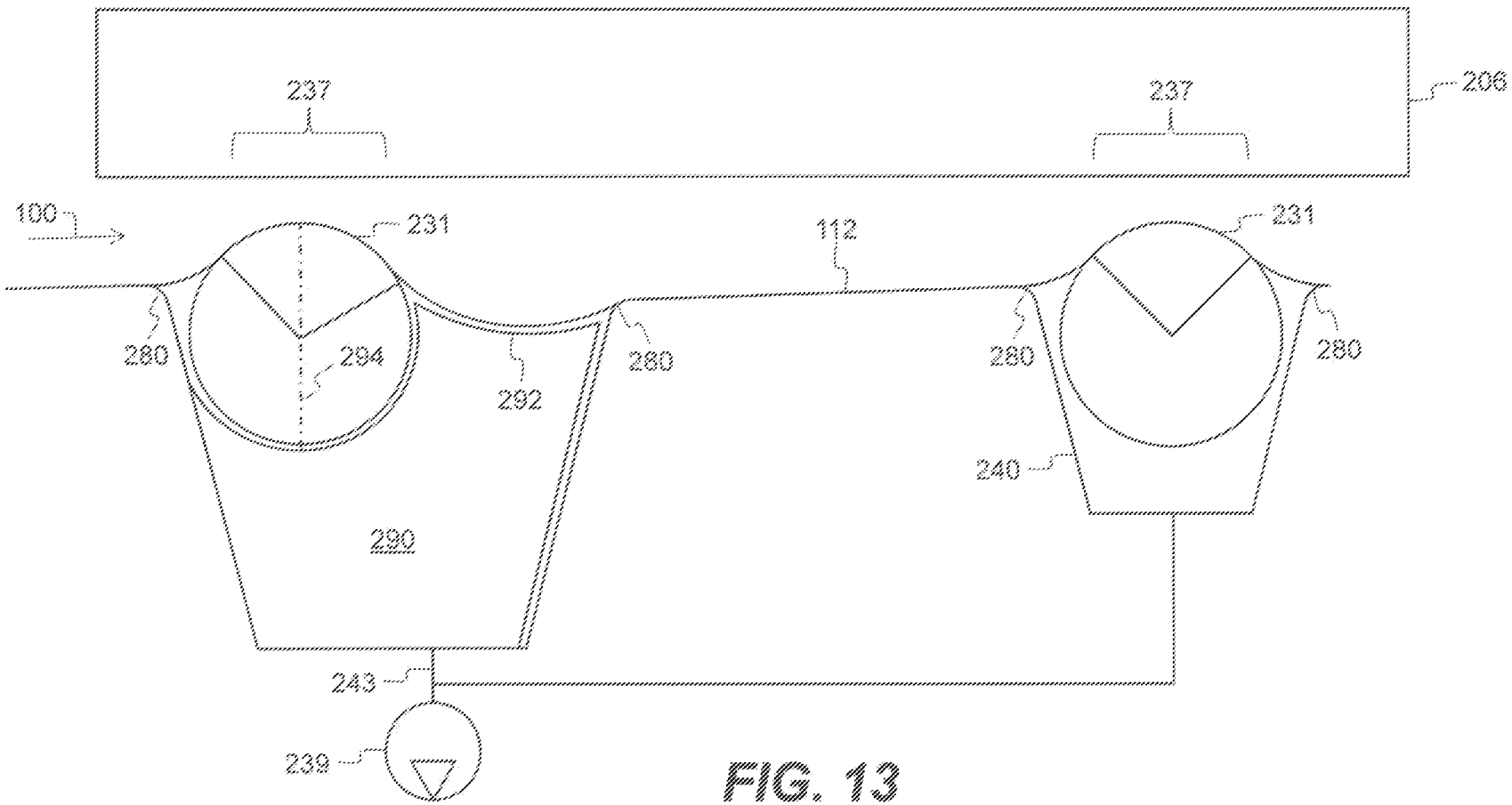
FIG. 13 is a schematic side view of a portion of a printing system that includes a vacuum assembly that provides asymmetrical wrap of the print medium around an aligned transport roller in an aspect of the invention.

FIG. 13 shows another aspect of the invention in which the left vacuum manifold 240 is asymmetrically configured around the aligned transport roller 231. The vacuum manifold has additional width to the downstream side of the aligned transport roller 231, compared to the width of the vacuum manifold on the upstream side of the aligned transport roller 231; the width measurements made along the direction of medium travel. This asymmetric configuration produces a wrap around the aligned transport roller 231 that is not symmetric about the vertical centerline 294 of the roller; the wrap extends further on the downstream side of the aligned transport roller 231 than it does on the upstream side of the roller. While the illustrated aspect of the invention has additional width on the downstream side of the roller when compared to the width on the upstream side of the roller, other aspects of the invention can have the additional width on the upstream side of the roller rather than the downstream side. Such asymmetric vacuum manifolds can be useful when there is a need to increase the wrap angle of the print medium around a roller but there is little or no need to alter the wrap angle on one of the upstream side or the downstream side of the aligned transport roller 231.

In both the vacuum manifold aspects of the invention of FIG. 13, the vacuum manifolds have skid pads 280 for guiding the print medium and providing vacuum seals along the leading and trailing edges of the vacuum manifold. The left vacuum manifold 240 includes movable end walls 290 for adjusting the effective width of the vacuum manifold to accommodate different widths of the print medium 112. The upper surface 292 of the end wall 290 includes an upward curvature to match the upward curvature of the print medium 112.

Figure 14:
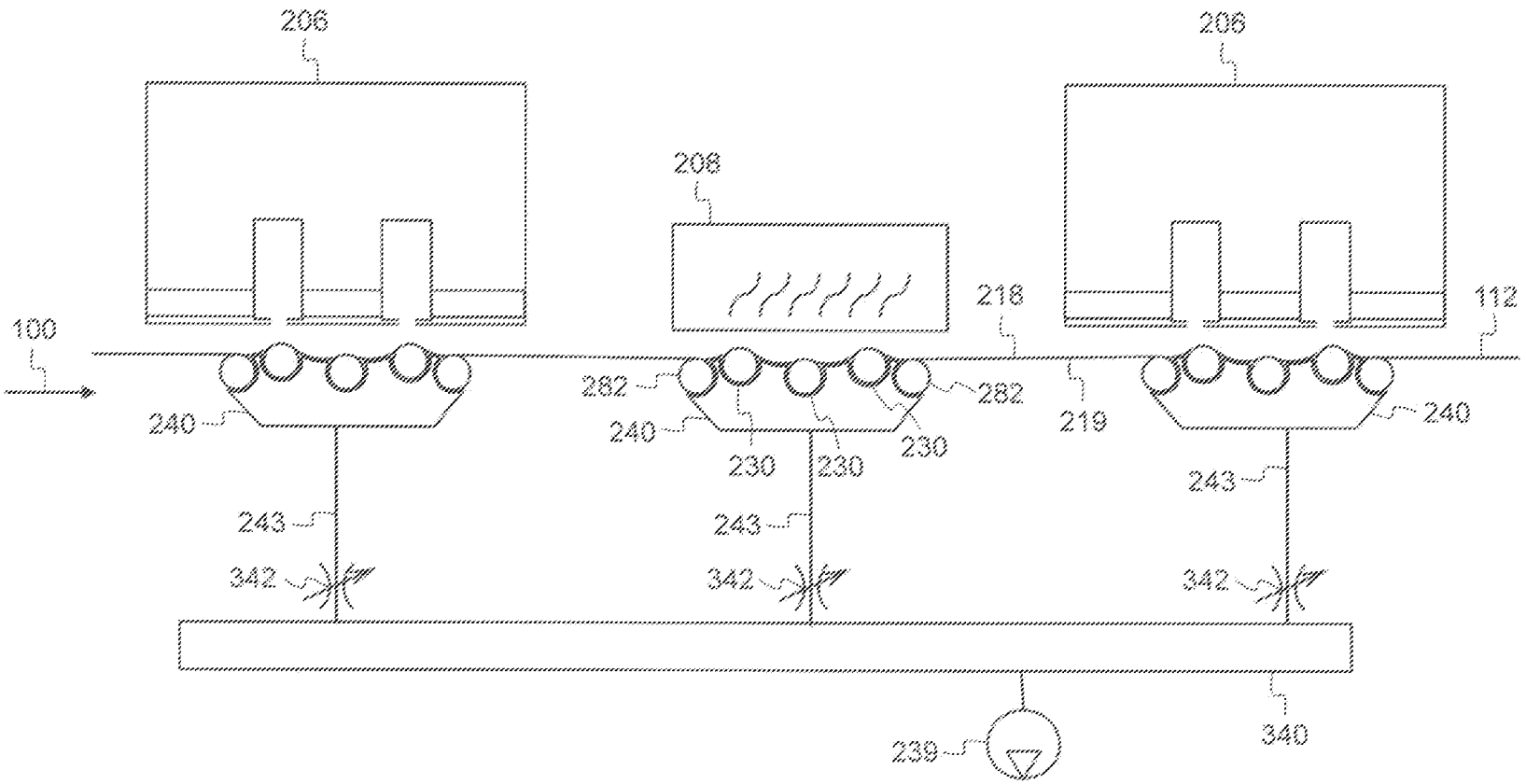
FIG. 14 is a schematic side view of a portion of a printing system that includes a plurality of vacuum assemblies and a drying system in an aspect of the invention.

FIG. 14 shows an aspect of the invention of a portion of the printing system having two lineheads 206, each having two print zones 237, located above a first side of the print medium 112. Both the first and the second lineheads have one or more print zones at which they can deposit liquid, for example ink, onto the first side of the print medium. Vacuum manifolds 240 are located on the second side of the print medium 112; each vacuum manifold having at least one aligned transport roller 231. The aligned transport roller(s) 231 is aligned with one of the print zones 237 of the linehead. Each vacuum manifold 240 outputs a vacuum force proximate to the second side of the print medium 112 such that at least a portion of the print medium is deflected away from the linehead and towards the aligned transport roller thereby increasing the wrap angle of the print medium around the aligned transport roller 231. As the vacuum manifold assemblies each ensure that the print medium maintains contact with the aligned transport rollers 231, it is no longer necessary to locate the plurality of lineheads such that the printheads are positioned along an arc to maintain contact between the print medium 112 and the aligned transport rollers 231. This enables the first linehead and a second linehead of the printing system, the second linehead disposed downstream of the first linehead, to be disposed such that the jetting direction of the second linehead is parallel to a jetting direction of the first linehead. This permits the linehead to be designed for use at a single orientation, providing better performance, rather than designed to work across the range of linehead orientations required by the prior art arched print medium path with poorer performance.

FIG. 14 also illustrates a printing system where a dryer 208 is disposed opposite the first side of the print medium 112 and laterally adjacent to the first linehead 206. The print medium is supported under the dryer by transport rollers 230 with an integrated vacuum manifold 240. The vacuum provided by the vacuum manifold causes the print medium to be deflected toward transport rollers, which are not aligned with the print zones of the first or the second linehead, to increase the wrap angle around these transport rollers. The wrap of the print medium around these rollers creates regions of downward curvature at each of these transport rollers. The vacuum acting on the unsupported print medium between the rollers produces regions of upward curvature between each of the regions of downward curvature. This alternating pattern of upward and downward curvature regions effectively stiffens the print medium 112 to suppress or prevent the formation of flutes or wrinkles in the print medium that run parallel to the direction of medium travel denoted by arrow 100.

FIG. 14 also illustrates a printing system having a plurality of vacuum manifolds 240 connected to a common vacuum plenum 340. The common vacuum plenum enables a single vacuum source 239 to provide vacuum to a plurality of vacuum manifolds. Some aspects of the invention include one or more vacuum adjustment mechanisms 342 between the common vacuum plenum and the plurality of vacuum manifolds. The vacuum adjustment mechanism can be incorporated into the vacuum plenum, the vacuum manifolds, or the ducts between the two. The vacuum adjustment mechanism 342 can include adjustable flow restrictors, such as gate valve or butterfly valve mechanisms, to adjust the flow impedance in through the ducts from the vacuum manifold to the vacuum plenum. The vacuum adjustment mechanism enables the individual adjustment of the vacuum force provided by one or more of the individual vacuum manifolds of the plurality of vacuum manifolds. The vacuum adjustment mechanisms can, for example, equalize the vacuum force provided by each of the plurality of vacuum manifolds. Alternatively the vacuum force provided by one or more vacuum manifolds can be increased, decreased, or turned off relative to the vacuum force provided by other vacuum manifolds.

Figure 16:
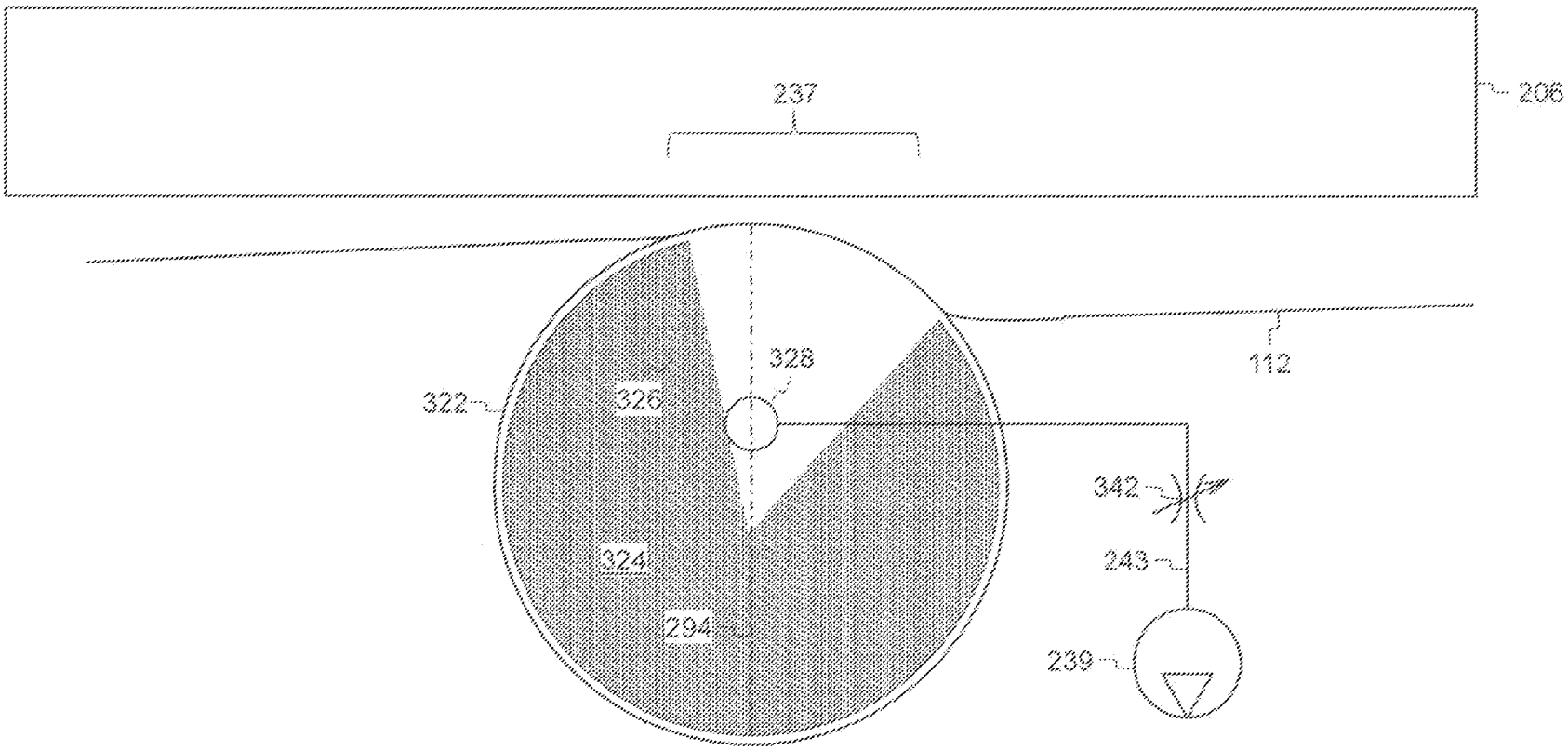
FIG. 16 is a schematic side view of a portion of a printing system that includes an asymmetrical vacuum transport roller in an aspect of the invention.

FIG. 15 is a schematic side view illustrating an aspect of the invention in which the vacuum manifold for acting on the print medium to increase the wrap of the print medium around the roller is internal to the roller. The vacuum roller 320 includes a porous sleeve 322 rotatable around a core 324. The core includes an internal vacuum manifold 326, which is connected to a vacuum source 239 via vacuum duct 243 and vacuum port 328. The vacuum manifold opens out to a portion of the inner surface of the porous sleeve so that vacuum is provided through the pores of the porous sleeve for this portion of the porous sleeve 322. By using the vacuum provided through this portion of the porous sleeve, a portion of the print medium 112 passing over the vacuum roller 320 is pulled into contact with the outer surface of the vacuum roller increasing the wrap angle of the print medium around the vacuum roller. The vacuum roller 320 containing the vacuum manifold 326 is aligned with a print zone 237 of the linehead 206. Limiting the vacuum manifold within this vacuum roller to a limited arc portion of the vacuum roller reduces the amount of air drawn into the vacuum roller when compared to a vacuum roller that provides suction throughout the entire circumference of the roller. In the aspect of the invention shown in FIG. 15, the vacuum manifold 326 is symmetrically placed relative to the vertical centerline 294 of the vacuum roller 320. As shown in FIG. 16, another aspect of the invention can include an asymmetrically placed vacuum manifold within the vacuum roller 320 to produce an increased wrap of the print medium around the roller which is asymmetric relative to the vertical centerline 294 of the vacuum roller 320.

In the example aspect shown in FIG. 15, the core 324 and the vacuum manifold 326 are of fixed size. In other aspects of the invention, the arc width of the vacuum manifold 326 can be adjusted to provide a larger or a smaller surface area over which the vacuum operates. As an example, the core 324 can be composed of compressible material that can be adjusted to change the effective size of the vacuum manifold 326. Further, the rotatable porous sleeve is engaged by the moving print medium that exerts a force on the porous sleeve causing it to rotate in a clockwise direction. The porous sleeve and the core can have a thin layer of air cushion to allow the sleeve to rotate around the core. In another example, the core can be made of material with low friction coefficient to allow the sleeve to rotate.

Figure 17:
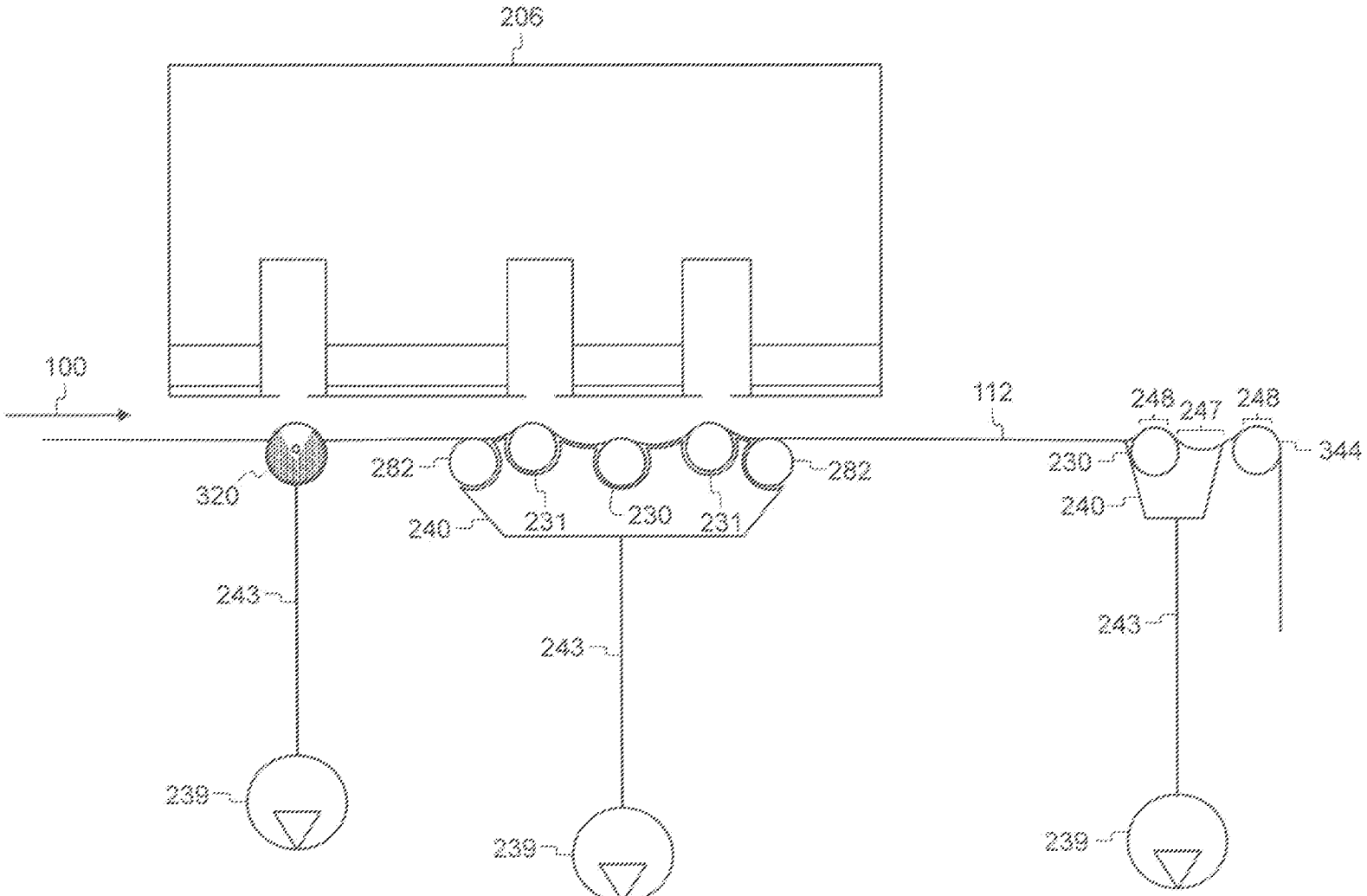
FIG. 17 is a schematic side view of a portion of a printing system that includes vacuum transport rollers and vacuum assemblies in an aspect of the invention.

FIG. 17 shows another application for the vacuum manifold partially surrounding a transport roller. A first linehead 206 is disposed opposite a first side of a print medium 112, the first linehead having one or more print zones where a liquid is deposited onto the first side of the print medium. At least one aligned transport roller 231 is disposed opposite the first linehead, adjacent to the second side of the print medium, and is aligned with a respective print zone of the linehead. A vacuum manifold 240 is disposed opposite a second side of the print medium, where the vacuum manifold is aligned with a print zone of the linehead and outputs a vacuum force proximate to the second side of the print medium such that at least a portion of the print medium is deflected away from the linehead and towards the aligned transport roller 231 thereby increasing the wrap angle of the print medium around the aligned transport roller. Downstream of the linehead 206 is a roller 344 around which the print medium is wrapped with a high wrap angle 244. Positioned between the roller 344 and the linehead 206 is a second vacuum manifold 240 that partially surrounds a transport roller 230. This transport roller 230 is not aligned with the print zone of any linehead. The second vacuum manifold is fluidically coupled to a vacuum source 239 through a vacuum duct 243. The second vacuum manifold, which is asymmetrically positioned around the transport roller 230, outputs a vacuum force proximate to the second side of the print medium deflecting the print medium between the transport roller 230 and high wrap angle roller 344 downward. This produces a region of upward curvature 247 in the print medium 112 immediately upstream of the roller 344. This upward curvature region 247 of the print medium located between the downward curvature regions 248 over the rollers 230 and 344 effectively stiffens the print medium to reduce the risk of the print medium 112 wrinkling as it wraps around the high wrap angle roller 344. As shown in FIG. 17, the printing system can include one or more aligned transport rollers 231 or one or more vacuum transport rollers 320. In some aspects of the invention, a mix of vacuum transport rollers 320 and aligned transport rollers 231 with vacuum manifolds 240 can be aligned with print zones of the linehead 206.

Figure 18:
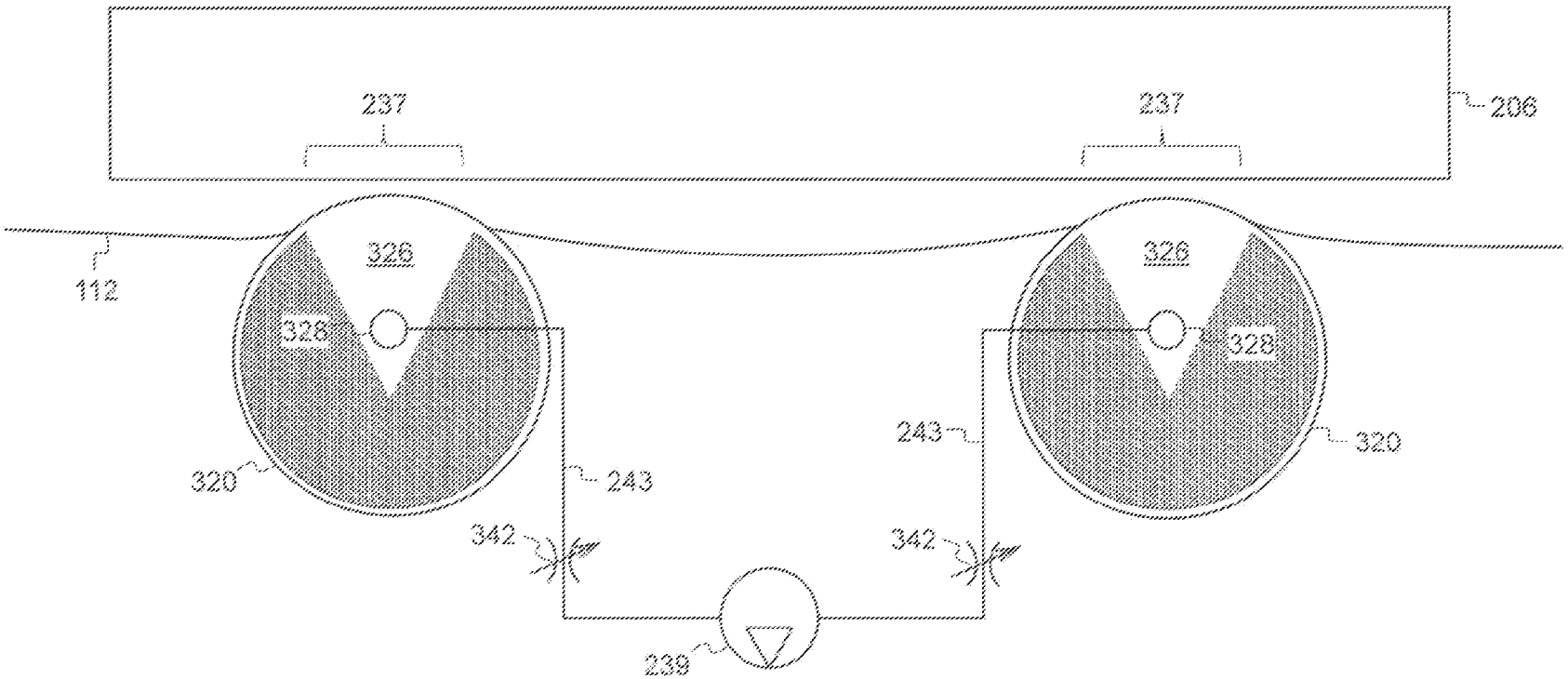
FIG. 18 is a schematic side view of a portion of a printing system that includes a plurality of vacuum transport rollers in an aspect of the invention.

FIG. 18 illustrates a printing system having a plurality of vacuum rollers 320 connected via vacuum ducts 243 to a single vacuum source 239 to provide vacuum to a plurality of vacuum manifolds. Some aspects of the invention include one or more vacuum adjustment mechanisms 342 between the vacuum source and the plurality of vacuum manifolds. The vacuum adjustment mechanism can be incorporated into the vacuum manifolds, or the ducts between the two. The vacuum adjustment mechanism 342 can include adjustable flow restrictors, such as gate valve or butterfly valve mechanisms, to adjust the flow impedance in through the ducts from the vacuum manifold to the vacuum plenum. The vacuum adjustment mechanism enables the individual adjustment of the vacuum force provided by one or more of the individual vacuum manifolds of the plurality of vacuum manifolds. The vacuum adjustment mechanisms can, for example, equalize the vacuum force provided by each of the plurality of vacuum manifolds. Alternatively the vacuum force provided by one or more vacuum manifolds can be increased, decreased, or turned off relative to the vacuum force provided by other vacuum manifolds.

Figure 19:
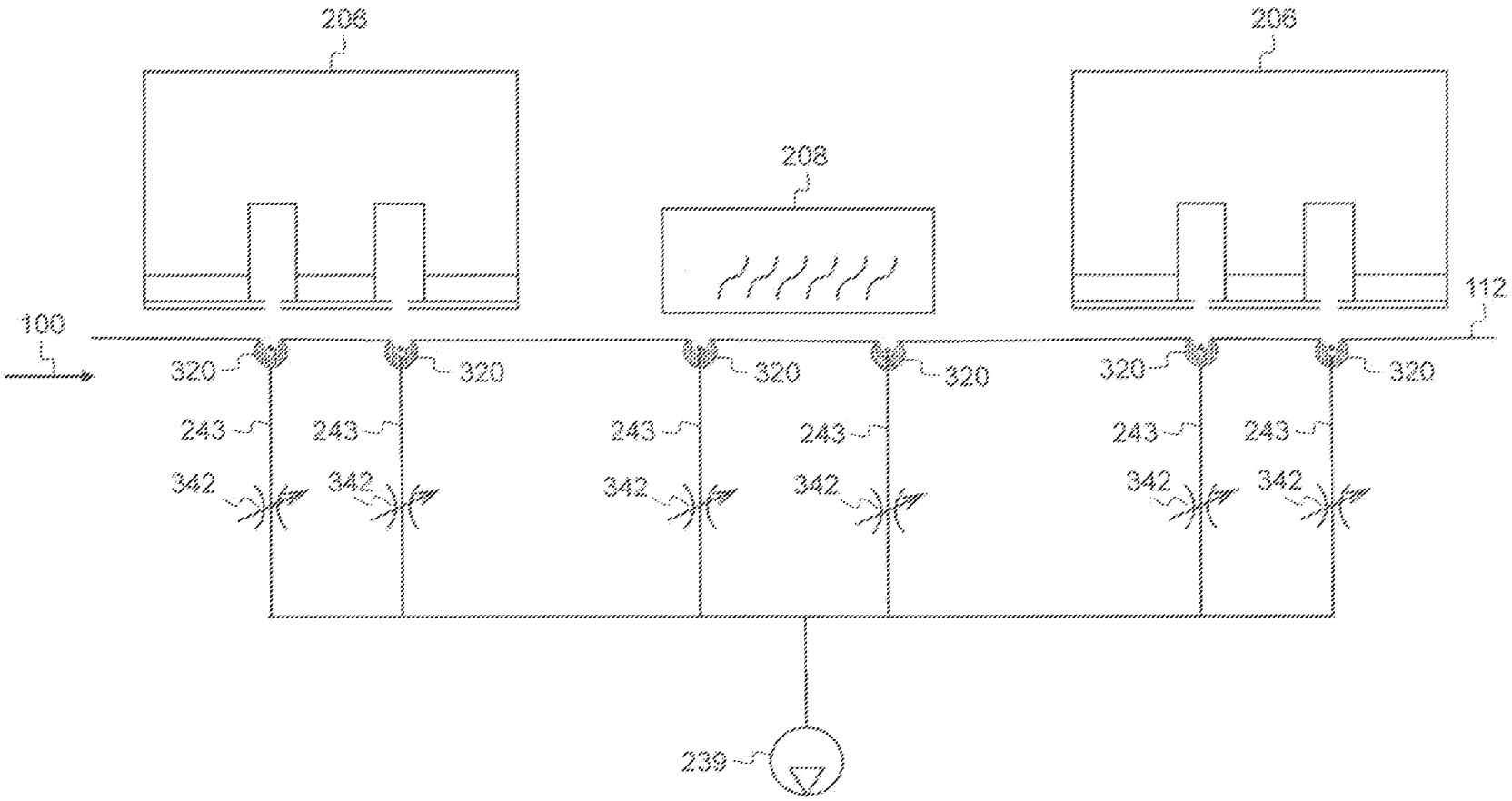
FIG. 19 is a schematic side view of a portion of a printing system that includes a plurality of vacuum transport rollers and a dryer in an aspect of the invention.

FIG. 19 shows an aspect of the invention of a portion of the printing system having two lineheads 206, each having two print zones 237, located above a first side of the print medium 112. Both the first and the second lineheads have one or more print zones at which they can deposit liquid, for example ink, onto the first side of the print medium. One or more vacuum rollers 320 are located on the second side of the print medium 112. The vacuum transport roller(s) 320 is aligned with one of the print zones 237 of the linehead. Each vacuum roller 320 outputs a vacuum force proximate to the second side of the print medium 112 such that at least a portion of the print medium is deflected away from the linehead and towards the vacuum roller thereby increasing the wrap angle of the print medium around the vacuum transport roller 320. As the vacuum force operated on the print medium ensure that the print medium maintains contact with the vacuum rollers 231, it is no longer necessary to locate the plurality of lineheads such that the printheads are positioned along an arc to maintain contact between the print medium 112 and the vacuum rollers 320. This enables the first linehead and a second linehead of the printing system, the second linehead disposed downstream of the first linehead, to be disposed such that the jetting direction of the second linehead is parallel to a jetting direction of the first linehead. This permits the linehead to be designed for use at a single orientation, providing better performance, rather than designed to work across the range of linehead orientations required by the prior art arched print medium path with poorer performance.

FIG. 19 also illustrates a printing system where a dryer 208 is disposed opposite the first side of the print medium 112 and laterally adjacent to the first linehead 206. The print medium is supported under the dryer by vacuum transport rollers 320. The vacuum provided by the vacuum manifold I the vacuum roller causes the print medium to be deflected toward the vacuum transport rollers, which are not aligned with the print zones of the first or the second linehead, to increase the wrap angle around these vacuum rollers. The wrap of the print medium around these rollers creates regions of downward curvature at each of these vacuum transport rollers. The vacuum acting on the unsupported print medium between the rollers can produce regions of upward curvature between each of the regions of downward curvature. This alternating pattern of upward and downward curvature regions effectively stiffens the print medium 112 to suppress or prevent the formation of flutes or wrinkles in the print medium that run parallel to the direction of medium travel denoted by arrow 100.

FIG. 19 also illustrates a printing system having a plurality of vacuum rollers 320 connected to a single vacuum source 239 to provide vacuum to a plurality of vacuum rollers. Some aspects of the invention include one or more vacuum adjustment mechanisms 342 between the common vacuum source and the plurality of vacuum rollers. The vacuum adjustment mechanism can be incorporated into the vacuum rollers, or the ducts between the two. The vacuum adjustment mechanism 342 can include adjustable flow restrictors, such as gate valve or butterfly valve mechanisms, to adjust the flow impedance in through the ducts from the vacuum roller to the vacuum source. The vacuum adjustment mechanism enables the individual adjustment of the vacuum force provided by one or more of the individual vacuum manifolds of the plurality of vacuum rollers. The vacuum adjustment mechanisms can, for example, equalize the vacuum force provided by each of the vacuum manifolds in the vacuum rollers. Alternatively the vacuum force provided by one or more vacuum rollers can be increased, decreased, or turned off relative to the vacuum force provided by other vacuum rollers.

Figure 20:
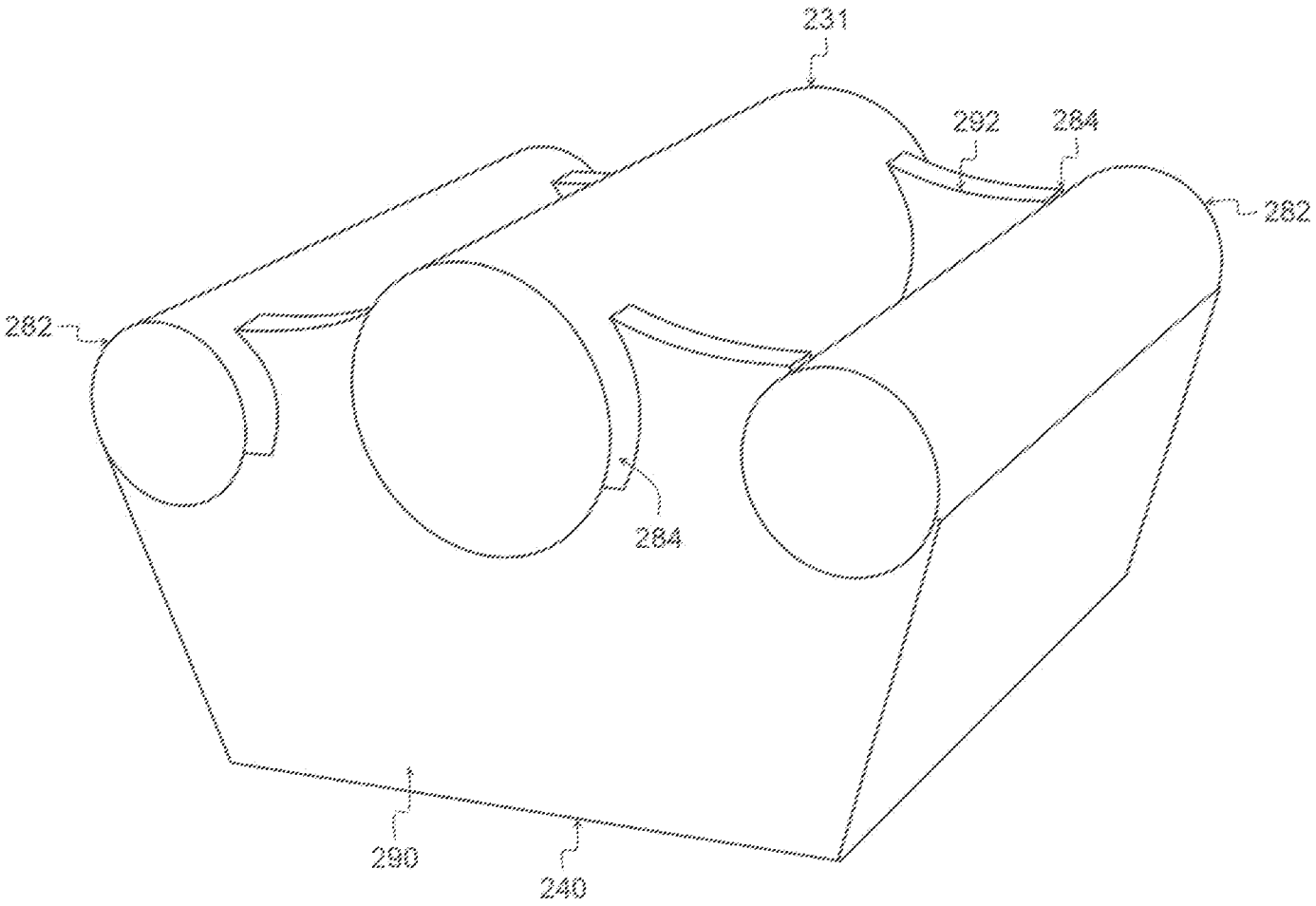
FIG. 20 is a perspective view of a vacuum manifold in an aspect of the invention.

FIG. 20 shows a perspective drawing of a vacuum manifold 240 according to an aspect of the invention. The vacuum manifold 240 has movable end walls 290 that can be used to adjust the volume of the vacuum manifold to accommodate print medium of varying widths. The vacuum manifold 240 may have sealing rollers 282 to limit the flow of air into the vacuum manifold. The upper surfaces 292 of the vacuum manifold define openings in the vacuum manifold through which the vacuum force operates upon the print medium. In some aspects of the invention, the adjustment structure shown in FIGS. 8-10 can be placed on the top surface of the vacuum manifold to further adjust the flow of air through the vacuum manifold.

Figure 21:
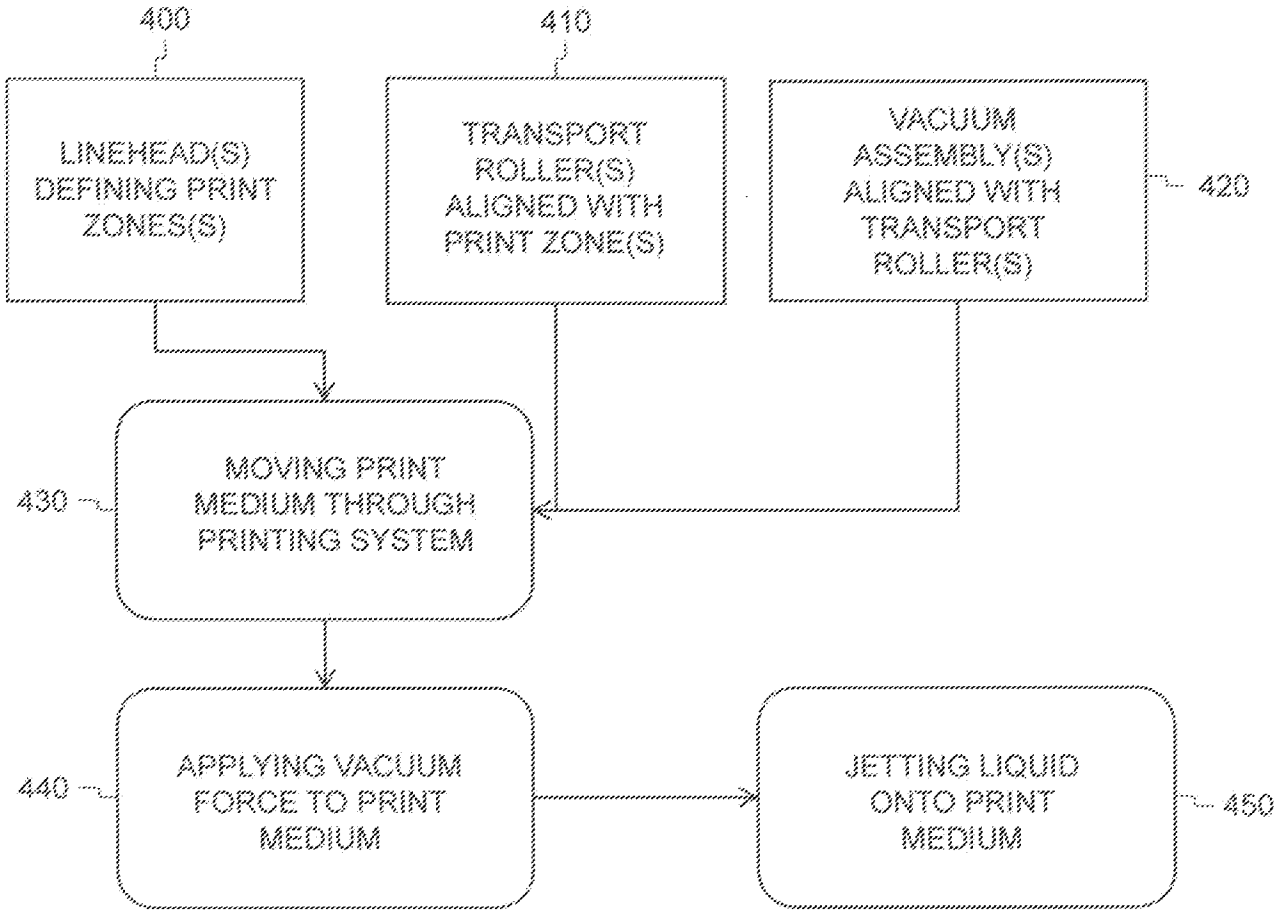
FIG. 21 is a flowchart showing a method of printing on a print medium in an aspect of the invention.

FIG. 21 is a flowchart showing a method of providing vacuum pulldown to a print medium according to an aspect of the invention. 1. In Step 400, a first linehead defining one or more print zones is provided. The first linehead is adapted to jet a liquid on a first side of the print medium in the one or more print zones. In Step 410, a plurality of transport rollers are provided. At least one transport roller is disposed opposite the first linehead, adjacent to the second side of the print medium, and is aligned with one of the print zones of the first linehead.

In one aspect of the invention, Step 420 provides a vacuum assembly having a vacuum manifold disposed opposite a second side of the print medium. The vacuum manifold of the vacuum assembly is aligned with the aligned transport roller. In another aspect of the invention, the transport rollers provided in Step 410 are vacuum transport rollers having a porous sleeve rotatable around a non-rotating core. In this aspect of the invention, the rotatable porous sleeve is engaged by the movable print medium that exerts a force on the porous sleeve causing it to rotate. At least one vacuum transport roller is disposed adjacent to the second side of the movable print medium and opposite the first linehead and is aligned with one of the one or more print zones of the first linehead. The vacuum assemblies provided in Step 420 are internal to the vacuum transport rollers. The core of the vacuum transport roller includes a vacuum manifold that outputs a vacuum force that operates on the second side of the movable print medium through the porous sleeve.

In Step 430, the print medium is moved through the printing system. In Step 440, a vacuum force is applied proximate to the second side of the print medium such that at least a portion of the moving print medium is deflected thereby increasing a wrap angle of the moving print medium around the transport roller (either the aligned transport roller with a vacuum assembly or the vacuum transport roller). In Step 450, liquid from the first linehead is jetted onto the first side of the moving print medium to form a print. In some aspects of the invention, the method includes connecting a vacuum source to the vacuum manifold.

In some aspects of the invention, an adjustment structure to adjust an effective width of the vacuum manifold can also be provided. As shown in FIGS. 8-10, the adjustment structure can include a fixed cover having an array of apertures of varying dimensions and a sliding cover disposed adjacent to the fixed cover having an array of apertures with each aperture having a common fixed dimension. The adjustment structure can be used to change the aperture size thereby changing the vacuum force operating on the print medium. The vacuum manifold defines a volume and this volume of the manifold can be adjusted to change the vacuum force operating on the print medium.

In aspect of the invention, the vacuum manifold partially surrounds the aligned transport roller and the method of printing on the print medium further includes providing at least one opening in the vacuum manifold to cause the vacuum force to operate on the print medium. In some aspects of the invention, there can be a plurality of transport rollers, each aligned with the one or more print zones of the first linehead. The method of printing can further include providing one or more vacuum manifolds connected to a vacuum source that cause a vacuum force to operate on the print medium and deflect the print medium causing an increase in the wrap angle of the print medium around each of the plurality of aligned transport rollers. The plurality of vacuum manifolds to a can be connected to a common vacuum plenum that enables a single vacuum source to provide the vacuum force operating on the print medium through each of the transport rollers. In these aspects of the invention, a plurality of vacuum adjustment mechanisms can be provided to change the vacuum force provided by a corresponding one of the plurality of vacuum manifolds.

The invention has been described in detail with particular reference to certain preferred aspects of the invention thereof, but it will be understood that variations and modifications can be effected within the spirit and scope of the invention.

PARTS LIST

100 Arrow Denoting Direction of Print Medium Travel
102 Crosstrack Direction
104 Flute
108 Roller
112 Print Medium
112A Dashed Line Denoting Print Medium Location in Printing System
200 Printing System
202 First Module
204 Second Module
206 Linehead
208 Dryer
210 Quality Control Sensor
216 Turnover Mechanism
220 Printhead
222 Nozzle Array
224 Support Structure
228 Clearance Gap
230 Transport Roller
231 Aligned Transport Roller
232 Print Line
234 Overlap Region
237 Print Zone
238 Vacuum Assembly
239 Vacuum Source
240 Vacuum Manifold
242 Non-print Zone
243 Vacuum duct
244 Wrap Angle
244A Wrap Angle
246 Adjustment Structure
247 Region of Upward Curvature
248 Region of Downward Curvature
250 Sliding Cover
252 Fixed Cover
254 First Aperture Array
256 Second Aperture Array
258 Third Aperture Array
260 Aperture
262 Width
264 Width
266 Width
280 Skid Pads
281 Guide Roller
282 Sealing Rollers
284 Airflow Gap
286 Polymeric blade
290 End Wall
292 Upper surface
294 Vertical Centerline
320 Vacuum Roller
322 Porous Sleeve
324 Core
326 Internal Vacuum Manifold
328 Vacuum Port
340 Vacuum Plenum
342 Vacuum Adjustment Mechanism
344 High Wrap Angle Roller
400 Step of Providing Linehead(s) Defining Print Zone(s)
410 Step of Providing Transport Rollers(s) Aligned with Print Zone(s)
420 Step of Providing Vacuum Assmebly(ies) Aligned with Transport Rollers(s)
430 Step of Moving Print Medium Through Printing System
440 Step of Applying Vacuum Force to Print Medium
450 Step of Jetting Liquid onto Print Medium

The invention claimed is:

1. A method for printing on a moving print medium in a printing system, including:

providing a first linehead defining one or more print zones, the first linehead adapted to jet a liquid on a first side of the print medium in the one or more print zones;

providing a plurality of transport rollers, wherein at least one transport roller is disposed opposite the first linehead, adjacent to a second side of the print medium, and is aligned with one of the print zones of the first linehead;

providing a vacuum assembly having a vacuum manifold disposed opposite the second side of the print medium, wherein the vacuum manifold of the vacuum assembly is aligned with the aligned transport roller, and wherein sealing rollers are disposed adjacent to the second side of the print medium and laterally adjacent to the vacuum manifold to prevent leakage of air;

moving the print medium through the printing system;

applying a vacuum force proximate to the second side of the print medium such that at least a portion of the moving print medium is deflected thereby increasing a wrap angle of the moving print medium around the aligned transport roller; and jetting liquid from the first linehead onto the first side of the moving print medium to form a print.

2. The method according to claim 1, further including connecting a vacuum source to the vacuum manifold.

3. The method according to claim 1, further including providing an adjustment structure to adjust an effective width of the vacuum manifold, wherein the adjustment structure includes, a fixed cover having an array of apertures of varying dimensions and a sliding cover disposed adjacent to the fixed cover having an array of apertures with each aperture having a common fixed dimension, and further including using the adjustment structure to change the aperture size thereby changing the vacuum force operating on the print medium.

4. The method according to claim 1, wherein the vacuum manifold defines a volume and further including adjusting the volume of the manifold to change the vacuum force operating on the print medium.

5. The method according to claim 1, wherein the vacuum manifold partially surrounds the aligned transport roller and further including providing at least one opening in the vacuum manifold to cause the vacuum force to operate on the print medium.

6. The method according to claim 1, wherein there are a plurality of transport rollers, each aligned with the one or more print zones of the first linehead, further including providing one or more vacuum manifolds connected to a vacuum source that cause a vacuum force to operate on the print medium and deflect the print medium causing an increase in the wrap angle of the print medium around each of the plurality of aligned transport rollers.

7. The method according to claim 6, further including connecting the plurality of vacuum manifolds to a common vacuum plenum.

8. The method according to claim 7, further including providing a plurality of vacuum adjustment mechanisms and using each vacuum adjustment mechanism to change the vacuum force provided by a corresponding one of the plurality of vacuum manifolds.

9. The method according to claim 1, wherein the sealing rollers are rotatable when the print medium is moved through the print zone and further including providing an airflow gap between the sealing roller and the vacuum manifold to permit rotation of the sealing roller.

10. The method according to claim 1, further including drying the liquid applied to the print medium.

11. The method according to claim 10, further including:

providing a dryer and one or more dryer transport rollers disposed adjacent to the second side of the print medium and aligned opposite to the dryer;

providing a second vacuum manifold disposed opposite the second side of the print medium, wherein the second vacuum manifold is aligned with the dryer; and using the second vacuum manifold to produce a second vacuum force that operates on the second side of the print medium to deflect the print medium causing an increase in the wrap angle of the print medium around the aligned dryer transport roller(s).

12. The method according to claim 1, further including providing a second linehead disposed downstream of the first linehead such that a jetting direction of the second linehead is parallel to a jetting direction of the first linehead.

13. A method for printing on a moving print medium in a printing system, including:

providing a first linehead defining one or more print zones, the first linehead adapted to jet a liquid on a first side of the print medium in the one or more print zones;

providing a plurality of transport rollers, wherein at least one transport roller is disposed opposite the first linehead, adjacent to a second side of the print medium, and is aligned with one of the print zones of the first linehead, and wherein at least one transport roller is not aligned with any of the print zones of the first linehead;

providing a first vacuum assembly having a vacuum manifold disposed opposite the second side of the print medium, wherein the vacuum manifold of the vacuum assembly is aligned with the aligned transport roller; wherein sealing rollers are disposed adjacent to the second side of the print medium and laterally adjacent to the vacuum manifold to prevent leakage of air providing a second vacuum assembly having a vacuum manifold disposed adjacent to the non-aligned transport roller such that the wrap angle of the moving print medium around the non-aligned transport roller prevents the formation of a wrinkle in the moving print medium; wherein sealing rollers are disposed adjacent to the second side of the print medium and laterally adjacent to the vacuum manifold to prevent leakage of air moving the print medium through the printing system;

applying a vacuum force proximate to the second side of the print medium such that at least a portion of the moving print medium is deflected thereby increasing a wrap angle of the moving print medium around the aligned transport roller; and jetting liquid from the first linehead onto the first side of the moving print medium to form a print.

14. The method according to claim 13, wherein the vacuum manifold defines a volume and further including adjusting the volume of the manifold to change the vacuum force operating on the print medium.

15. The method according to claim 13, further including:

providing a dryer and one or more dryer transport rollers disposed adjacent to the second side of the print medium and aligned opposite to the dryer;

providing a third vacuum manifold disposed opposite the second side of the print medium, wherein the third vacuum manifold is aligned with the dryer; and using the third vacuum manifold to produce a third vacuum force that operates on the second side of the print medium to deflect the print medium causing an increase in the wrap angle of the print medium around the aligned dryer transport roller(s).

16. The method according to claim 1, further including providing a second linehead disposed downstream of the first linehead such that a jetting direction of the second linehead is parallel to a jetting direction of the first linehead.

17. The method according to claim 13, further including disposing the non-aligned transport roller between the aligned transport roller and a high wrap angle transport roller such that the non-aligned transport roller causes the print medium to curve in a direction opposite to the direction of curvature of the print medium at the high wrap angle transport roller.

* * * * *